US007853189B2

(12) United States Patent
Kamoshita et al.

(10) Patent No.: US 7,853,189 B2
(45) Date of Patent: Dec. 14, 2010

(54) BELT MOVING DEVICE AND IMAGE FORMING APPARATUS USING SAME

(75) Inventors: Mikio Kamoshita, Koganei (JP); Koichi Kudo, Yokohama (JP); Masahiko Kato, Yokohama (JP); Hideaki Kibune, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 482 days.

(21) Appl. No.: 11/976,519

(22) Filed: Oct. 25, 2007

(65) Prior Publication Data

US 2008/0213009 A1 Sep. 4, 2008

(30) Foreign Application Priority Data

Oct. 30, 2006 (JP) ..... 2006-293844
Nov. 16, 2006 (JP) ..... 2006-310297
Nov. 24, 2006 (JP) ..... 2006-317246

(51) Int. Cl.
*G03G 15/01* (2006.01)
*G03G 15/20* (2006.01)

(52) U.S. Cl. ..... 399/302; 399/303; 399/308

(58) Field of Classification Search ..... 399/302, 399/303, 308

See application file for complete search history.

(56) References Cited

U.S. PATENT DOCUMENTS 6,925,279 B2 8/2005 Kamoshita et al.
2003/0223786 A1 12/2003 Kamoshita et al.
2007/0086813 A1 * 4/2007 Takeyama ..... 399/302

FOREIGN PATENT DOCUMENTS

| | | |
|---|---|---|
| JP | 06-263281 | 9/1994 |
| JP | 2002-251080 | 9/2002 |
| JP | 03399492 | 2/2003 |
| JP | 2003-241535 | 8/2003 |
| JP | 2005-091943 | 4/2005 |
| JP | 2005-148127 | 6/2005 |

* cited by examiner

*Primary Examiner*—David P Porta
*Assistant Examiner*—Mindy Vu
(74) *Attorney, Agent, or Firm*—Harness, Dickey & Pierce, P.L.C.

(57) ABSTRACT

In a belt moving device that is capable of reducing belt speed fluctuation and positional deviation from a target belt position in a sub-scanning direction and performing highly precise position control in a main scanning direction, and an image forming apparatus that uses this belt moving device to prevent color shift in both the main scanning direction and sub-scanning direction of a formed image such that a high-quality image can be formed, belt shift control means reduce shift position variation within a single round trip of an endless belt by feeding back a target value for canceling out the shift position variation within a single round trip of the endless belt and feeding forward a value obtained by multiplying an inverse transfer characteristic of moving means by a transfer characteristic of a target value of the moving means in relation to the control content of the moving means.

19 Claims, 32 Drawing Sheets

RELATED ART

RELATED ART

LOOP BLOCK DIAGRAM

BELT MOVING DEVICE AND IMAGE FORMING APPARATUS USING SAME

BACKGROUND OF THE INVENTION

1. Field of the Invention

The present invention relates to an image forming apparatus such as a copier, a printer, or a facsimile device, and more particularly to a belt moving device such as an intermediate transfer belt or a sheet conveyor belt used in the image forming apparatus.

2. Description of the Related Art

In this type of belt moving device, a shifting guide is provided on an end surface of the belt to suppress belt shifting when the belt is driven. However, the straightness of the shifting guide is approximately 200 μm/1200 mm, and therefore the belt meanders, leading to deviation in the belt position as the driving time lengthens. In a tandem type color copier, for example, belt meandering of this type causes registration variation in the main scanning direction of a formed image. Hence, in a conventional belt moving device, the belt traveling speed is typically controlled, as described in publications such as Japanese Unexamined Patent Application Publication 2005-091943, Japanese Unexamined Patent Application Publication H06-263281, and Japanese Unexamined Patent Application Publication 2003-241535.

However, as will be described below, it is difficult to achieve control with a satisfactory degree of precision in the conventional belt moving devices described in these publications, and as a result, color shift occurs in both the main scanning direction and the sub-scanning direction of the formed image. Accordingly, high quality images cannot be obtained.

SUMMARY OF THE INVENTION

It is an object of the present invention to provide a belt moving device and an image forming apparatus using the belt moving device which are capable of preventing color shift in both the main scanning direction and the sub-scanning direction of a formed image so that a high quality image can be obtained.

In an aspect of the present invention, a belt moving device comprises an endless belt; a drive roller for moving/stopping the endless belt; at least one opposing roller disposed in a position opposing the drive roller; a motor for rotating the drive roller; a position detecting means for detecting a position of the endless belt; moving means capable of moving at least one of the rollers to a vertical direction target rotation position; and belt shift control means for controlling belt shift in accordance with a traveling speed of the endless belt while the endless belt is in motion.

In another aspect of the present invention, a tandem type image forming apparatus uses a belt moving device as an intermediate transfer belt. The belt moving device comprises an endless belt; a drive roller for moving/stopping the endless belt; at least one opposing roller disposed in a position opposing the drive roller; a motor for rotating the drive roller; position detecting means for detecting a position of the endless belt; moving means capable of moving at least one of the rollers to a vertical direction target rotation position; and belt shift control means for controlling belt shift in accordance with a traveling speed of the endless belt while the endless belt is in motion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Before describing the present invention, the related art and the problems therein will be described with reference to the drawings.

First, an outline of a tandem type image forming apparatus employing an intermediate transfer belt will be described as an example of a belt moving device.

Figure 1:
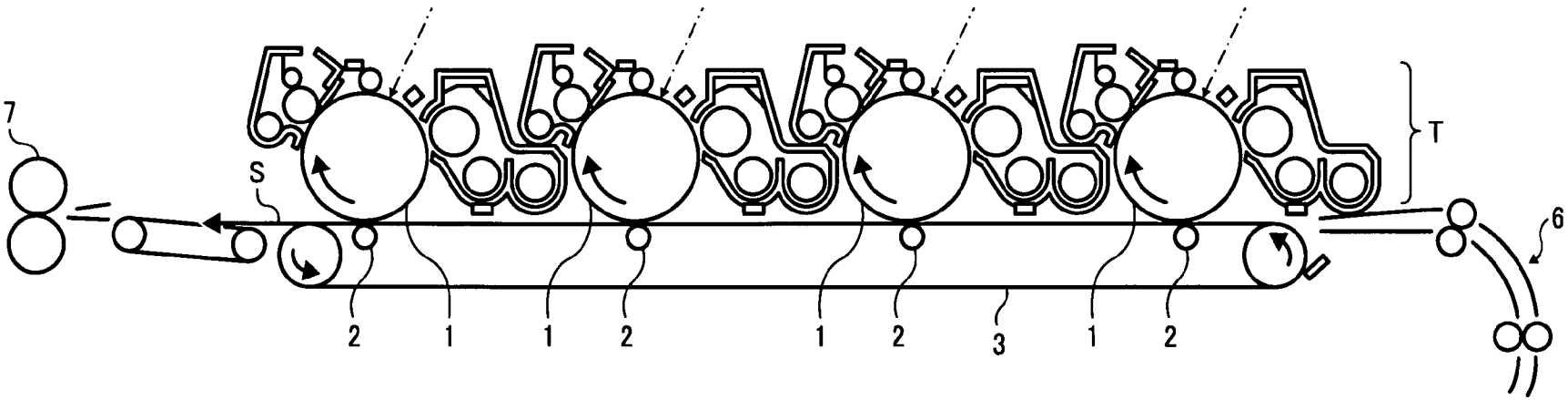
FIG. 1 is a view showing the schematic constitution of an image forming portion of a tandem type color printer.
Figure 2:
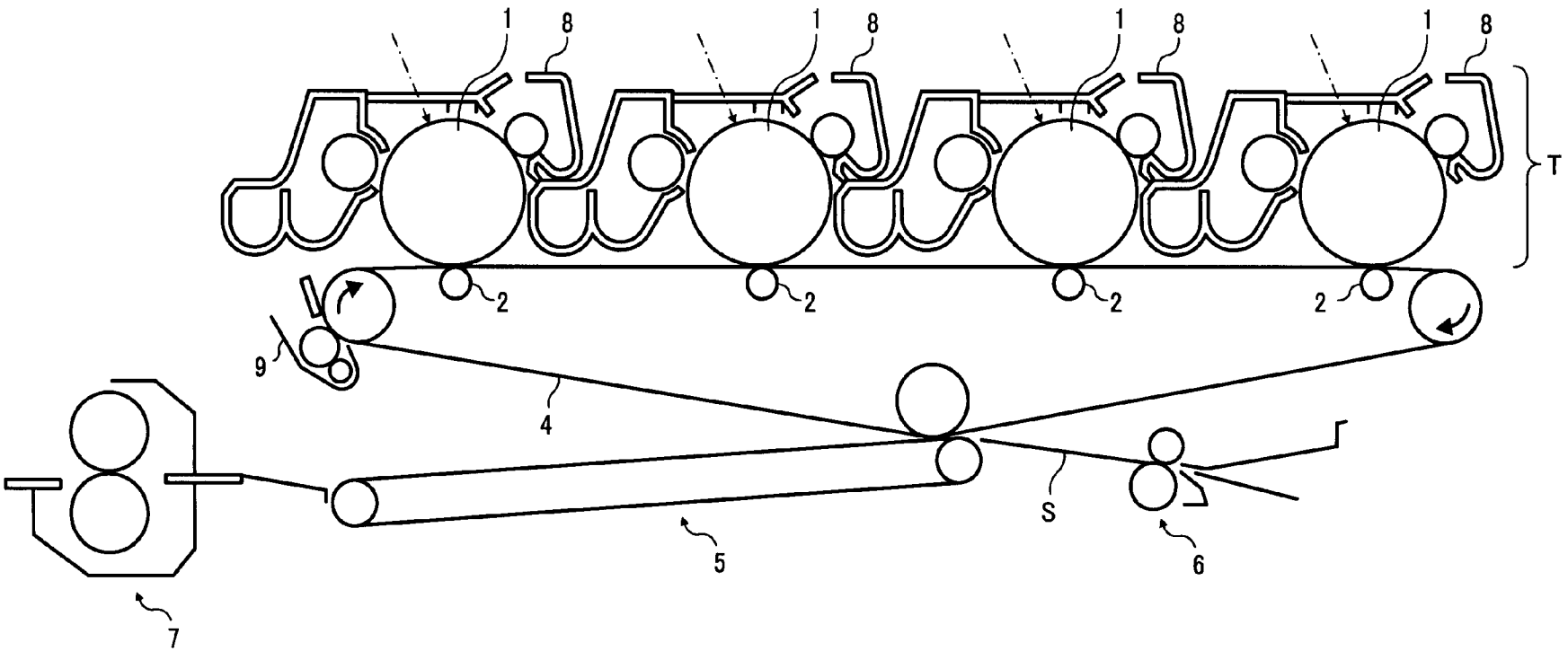
FIG. 2 is a view showing the schematic constitution of an image forming portion of a color printer comprising an intermediate transfer belt.

As shown in FIG. 1, a tandem type electrophotographic device may employ a direct transfer system in which a transfer device 2 transfers images formed respectively on photosensitive bodies 1 onto a sheet S conveyed by a sheet conveyor belt 3 in sequence, or an indirect transfer system, such as that shown in FIG. 2, in which the images formed respectively on the photosensitive bodies 1 are transferred in sequence onto an intermediate transfer body 4 by a primary transfer device 2, whereupon the images on the intermediate transfer body 4 are transferred onto a sheet S together by a secondary transfer device 5. Note that the transfer device 5 is a transfer conveyor belt, but may take the form of a roller.

Compared with the indirect transfer system, the direct transfer system is disadvantaged in that a sheet feeding device 6 and a fixing device 7 must be disposed respectively on the upstream side and downstream side of a tandem type image forming apparatus T in which the photosensitive bodies 1 are arranged in series, and as a result, the tandem type image forming apparatus T increases in size in a sheet conveyance direction. With the indirect transfer system, on the other hand, the secondary transfer position can be set comparatively freely. Moreover, the sheet feeding device 6 and fixing device 7 can be disposed so as to overlap the tandem type image forming apparatus T, enabling a reduction in size.

To prevent a size increase in the sheet conveyance direction of the former system, the fixing device 7 is disposed in close proximity to the tandem type image forming apparatus T. In so doing, however, the sheet S cannot be provided with sufficient leeway to bend, and therefore the fixing device 7 is likely to affect image formation on the upstream side due to an impact created when the tip end of the sheet S enters the fixing device 7 (this impact being particularly striking when the sheet is thick) and a speed difference between the sheet conveyance speed when passing through the fixing device 7 and the sheet conveyance speed of a transfer conveyor belt. With the latter system, on the other hand, the fixing device 7 can be disposed so as to provide the sheet S with sufficient leeway to bend, and therefore the fixing device 7 has substantially no effect on image formation.

In consideration of these points, tandem type electrophotographic devices employing the indirect transfer system have been gaining attention in recent years. As shown in FIG. 2, in this type of color electrophotographic device, a photosensitive body cleaning device 8 removes residual toner remaining on the photosensitive body 1 following primary transfer so as to clean the surface of the photosensitive body 1 in preparation for the next image formation operation. Further, an intermediate transfer body cleaning device 9 removes residual toner remaining on the intermediate transfer body 4 following secondary transfer so as to clean the surface of the intermediate transfer body 4 in preparation for the next image formation operation.

A representative example of a tandem type indirect transfer system electrophotographic device will now be described with reference to the drawings.

Figure 3:
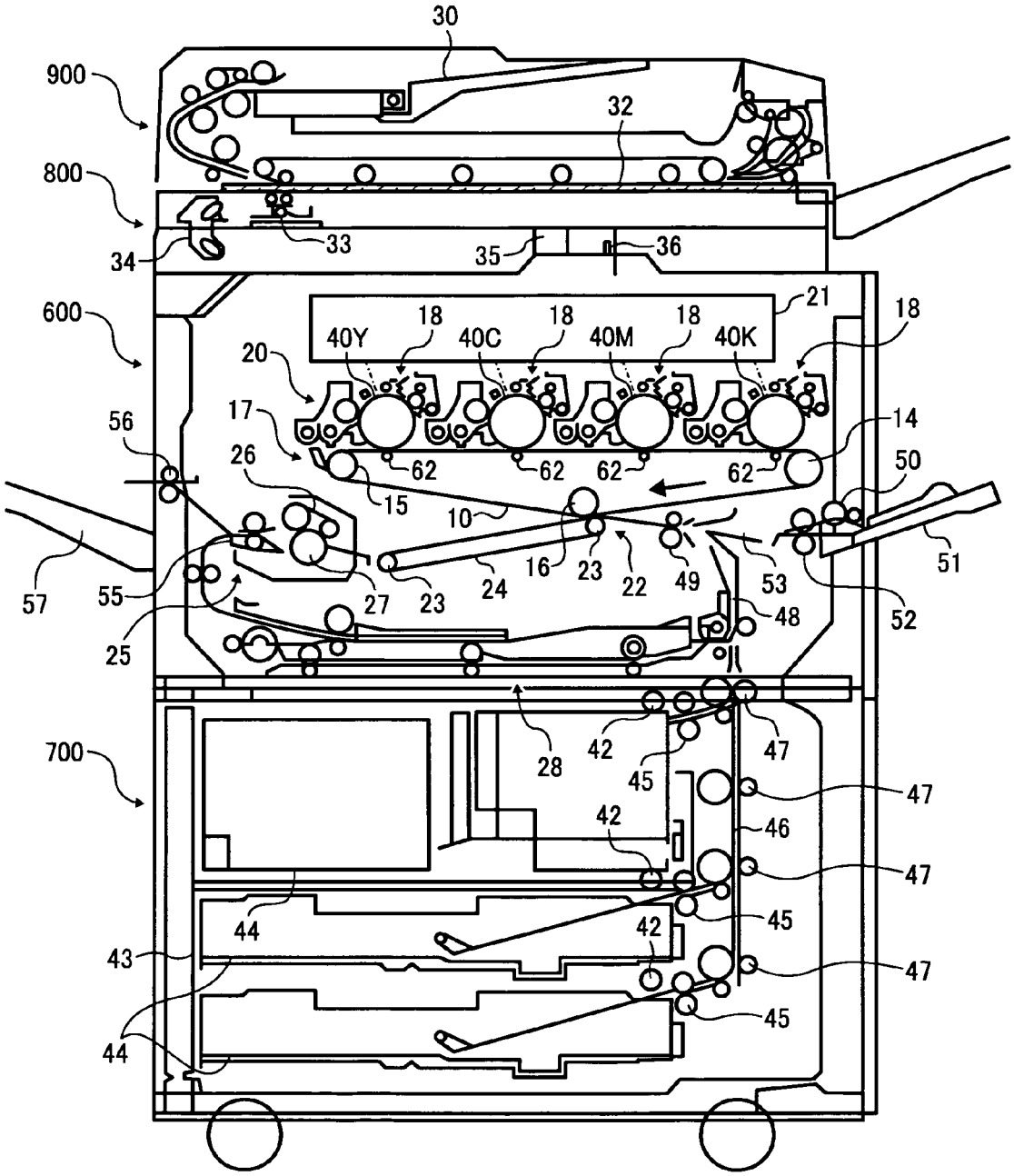
FIG. 3 is a view showing the overall schematic constitution of an electrophotographic device employing a tandem type image transfer system.

FIG. 3 shows the overall schematic constitution of a tandem type indirect transfer system electrophotographic device. Reference numerals 600, 700, 800 and 900 in the drawing respectively denote a copying device main body, a sheet feeding table carrying the copying device main body 600, a scanner mounted on the copying device main body 600, and an automatic document feeder (ADF) mounted on the scanner 800.

Figure 4:
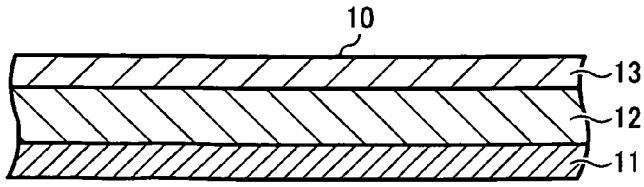
FIG. 4 is a sectional view showing an example of the constitution of the intermediate transfer belt.

An endless belt-shaped intermediate transfer body 10 (to be referred to as an intermediate transfer belt 10 hereafter) is provided in the center of the copying device main body 600. As shown in the sectional view in FIG. 4, the intermediate transfer belt 10 is formed by manufacturing a base layer 11 from a fluororesin that stretches only slightly or a combination of a rubber material that stretches greatly and a material that does not stretch easily such as canvas, for example, and providing an elastic layer 12 thereon. The elastic layer 12 is formed from a material such as fluororubber or acrylonitrile-butadiene copolymer rubber, for example. The surface of the elastic layer 12 is coated with fluororesin, for example, to form a coating layer 13 having favorable smoothness.

As shown in FIG. 3, in the illustrated example, the intermediate transfer belt 10 is wrapped around three support rollers 14, 15, 16 so as to be capable of rotary conveyance in the clockwise direction of the drawing. In the illustrated example, an intermediate transfer belt cleaning device 17 for removing residual toner from the intermediate transfer belt 10 following image transfer is provided on the left of a second support roller 15 from among the three support rollers. Further, four image forming means 18 corresponding to the colors yellow, cyan, magenta, and black are arranged on the intermediate transfer belt 10, which is wrapped around a first support roller 14 and the second support roller 15 from among the three support rollers, in horizontal series in the conveyance direction thereof, thereby forming a tandem image forming apparatus 20. In the tandem image forming apparatus 20, the individual image forming means 18 each comprise a charging device 60, a development device 61, a primary transfer device 62, a photosensitive body cleaning device 63, a neutralizing device 64, and so on, which are arranged around a drum-shaped photosensitive body 40, as shown in FIG. 5, for example.

Figure 5:
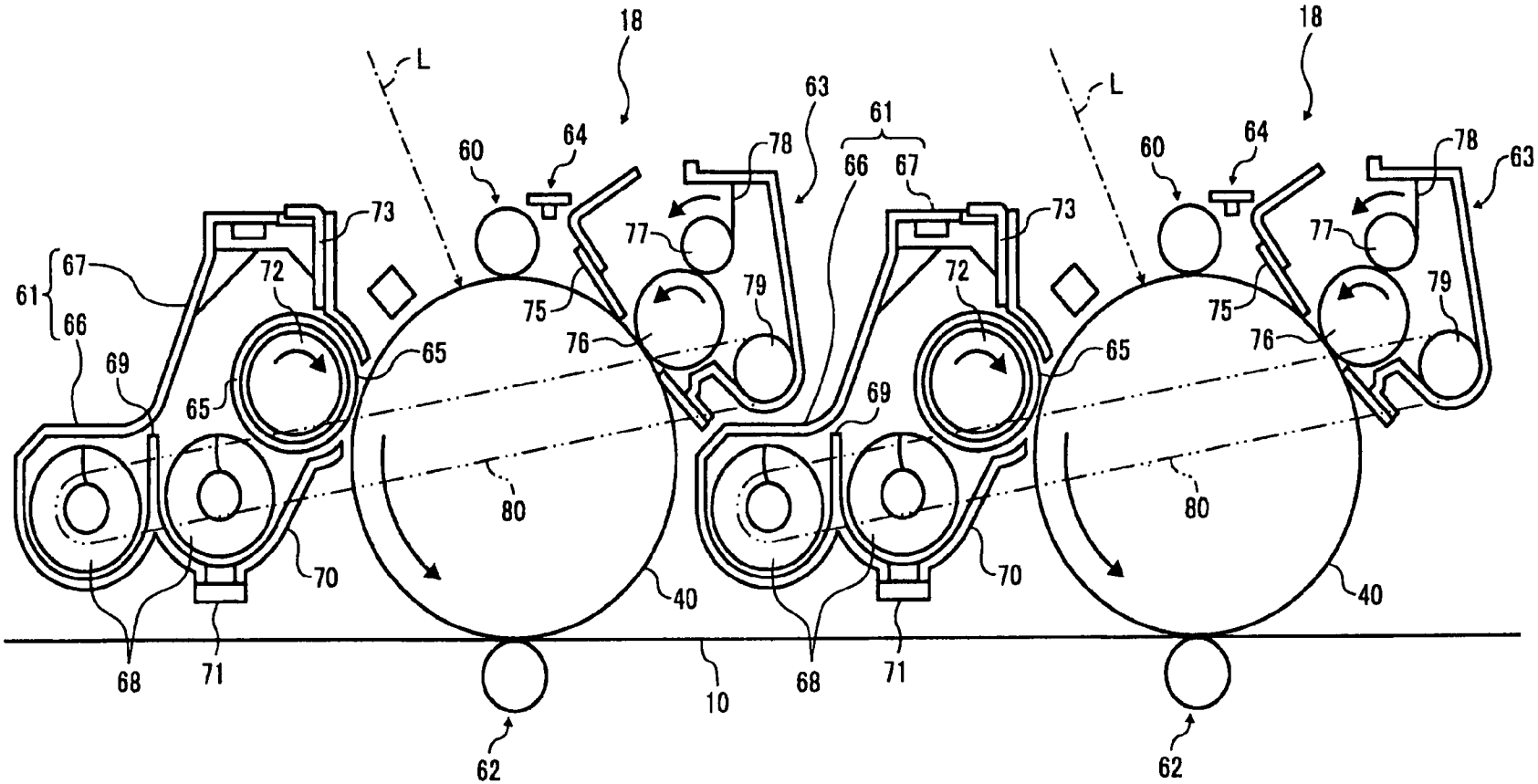
FIGS. 5 and 6 are views showing the constitution of a conventional belt moving device.

Note that the constitution shown in FIG. 5 corresponds to that disclosed in the aforementioned Japanese Unexamined Patent Application Publication 2005-91943, and the reference numerals in the drawing correspond to those used in this publication.

As shown in FIG. 3, an exposure device 21 is provided on the tandem image forming apparatus 20. Meanwhile, a secondary transfer device 22 is provided on the opposite side of the intermediate transfer belt 10 to the tandem image forming apparatus 20. In the illustrated example, the secondary transfer device 22 is formed by wrapping an endless belt serving as a secondary transfer belt 24 around two rollers 23, and is disposed so as to press a third support roller 16 via the intermediate transfer belt 10. Thus, an image formed on the intermediate transfer belt 10 is transferred onto a sheet.

The secondary transfer device 22 also has a sheet conveyance function for conveying the sheet to a fixing device 25 following image transfer. Needless to say, a transfer roller or a non-contact charger may be provided as the secondary transfer device 22. In this case, it becomes more difficult to provide the sheet conveyance function. Note that in the illustrated example, a sheet reversing device 28 for reversing the sheet so that images can be recorded on both surfaces of the sheet is provided below the secondary transfer device 22 and fixing device 25 in parallel with the tandem image forming apparatus 20. The fixing device 25, which fixes the transfer image onto the sheet, is provided in series with the secondary transfer device 22. The fixing device 25 presses a pressure roller 27 against an endless belt serving as a fixing belt 26.

The position of the intermediate transfer belt 10 used in this type of image forming apparatus and so on is controlled by a belt conveying device.

Figure 6:
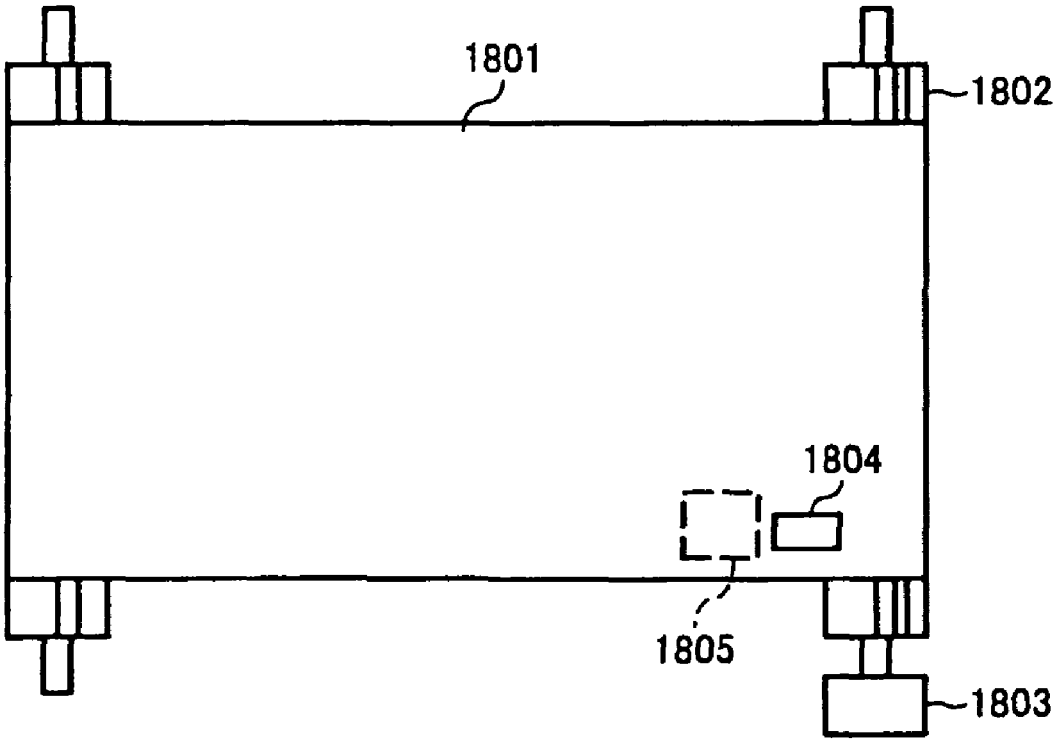

FIG. 6 shows a well-known belt conveying device disclosed in Japanese Unexamined Patent Application Publication H06-263281. In this belt conveying device, an encoder 1803 is provided in a drive roller 1802 for driving an endless belt 1801, and an index signal is generated every time the drive roller 1802 performs a single revolution. Further, a mark 1804 is provided in a single location on the belt 1801, and a sensor 1805 reads the time at which the mark 1804 passes.

When copying is performed using the color electrophotographic device described above, an original is set on an original table 30 of the automatic document feeder 900. Alternatively, the automatic document feeder 900 is opened and the original is set on a contact glass 32 of the scanner 800, whereupon the automatic document feeder 900 is closed to hold the original in place. Then, when a start switch not shown in the drawing is depressed and the original is set on the automatic document feeder 900, the original is conveyed onto the contact glass 32. On the other hand, when the original is set on the contact glass 32, the scanner unit 800 is driven immediately such that a first traveling body 33 and a second traveling body 34 are caused to travel. Light is then emitted from a light source in the first traveling body 33 and reflection light is reflected toward the second traveling body 34 from the surface of the original. This light is then reflected by a mirror on the second traveling body 34 so as to pass through an image-forming lens 35 and enter a reading sensor 36, in which the content of the original is read.

Further, when the start switch not shown in the drawing is depressed, a drive motor not shown in the drawing drives one of the three support rollers 14, 15, 16 to rotate such that the other two support rollers are rotated thereby. As a result, the intermediate transfer belt 10 is caused to rotate. At the same time, the photosensitive bodies 40 in the respective image forming means 18 rotate such that monochrome images in black, yellow, magenta, and cyan are formed on the respective photosensitive bodies 40. Then, as the intermediate transfer belt 10 rotates, these monochrome images are transferred thereon in succession such that a synthetic color image is formed on the intermediate transfer belt 10.

Meanwhile, when the start switch not shown in the drawing is depressed, one of a plurality of feed rollers 42 of the sheet feeding table 700 is rotated selectively such that sheets are fed from one of a plurality of sheet feeding cassettes 44 provided in tiers in a paper bank 43. After being separated into single sheets by a separating roller 45, the sheet is introduced into a feed passage 46 and led to a feed passage 48 in the copier main body 600 by a conveyance roller 47. The sheet is conveyed until it impinges on and is halted by a resist roller 49. Alternatively, when sheets are set on a manual feed tray 51, the sheets are fed onto the manual feed tray 51 by rotating a feed roller 50, separated into single sheets by a separating roller 52, introduced into a manual feed passage 53, and conveyed until they impinge on and are halted by the same resist roller 49.

The resist roller 49 is rotated at a timing corresponding to the synthetic color image on the intermediate transfer belt 10 such that the sheet is conveyed between the intermediate transfer belt 10 and the secondary transfer device 22, where the synthetic color image is transferred onto the sheet by the secondary transfer device 22 to form a color image.

Following image transfer, the sheet is conveyed to the fixing device 25 by the secondary transfer device 22. Heat and pressure are applied by the fixing device 25 to fix the transferred image, whereupon the sheet is switched by a switching pawl 55, discharged by a discharge roller 56, and stacked on a discharge tray 57. Alternatively, the sheet is switched by the switching pawl 55, introduced into the sheet reversing device 28, reversed thereby, and led back to the transfer position, where an image is recorded on the rear surface thereof. The sheet is then discharged onto the discharge tray 57 by the discharge roller 56. Meanwhile, residual toner remaining on the intermediate transfer belt 10 following image transfer is removed by the intermediate transfer belt cleaning device 17 in preparation for the next image forming operation by the tandem image forming apparatus 20. The resist roller 49 is typically grounded, but may be applied with a bias to remove paper particles therefrom.

The position of the intermediate transfer belt used in this type of image forming apparatus and so on is controlled by a belt conveying device. Control performed by the belt conveying device shown in FIG. 6 will now be described. In the belt conveying device, the encoder 1803 provided in the drive roller 1802 for driving the endless belt 1801 generates an index signal every time the drive roller 1802 performs a single revolution. Further, the mark 1804 is provided in a single location on the belt 1801, and the sensor 1805 reads the time at which the mark 1804 passes.

Control means (not shown) determine speed fluctuation (offset of the drive shaft) in the belt 1801 on the basis of the relationship between the index signal and a mark detection signal, and perform speed control to correct the offset. The belt 1801 is used as an intermediate transfer belt of an image forming apparatus and rotates once for every color used to form an image. The drive speed pattern of the first color is read from the mark 1804 on the belt 1801 and serves as the speed pattern of the second color onward.

To prevent speed fluctuation in the belt 1801 due to offset of the drive roller 1802, the drive roller 1802 is subjected to speed control in order to cancel out the speed fluctuation of the belt 1801. More specifically, using deviation in the belt circumference, an association between the rotary angle of the drive roller 1802 and the speed fluctuation of the belt 1801 is determined by Fourier transform, whereupon phase and modulation are applied to a target speed of the drive roller 1802 such that the speed of the belt 1801 is controlled to a fixed level.

However, in the belt conveying device described above, the position of the belt 1801 is controlled through speed control, and therefore positional deviation increases over time. This deviation appears as color shift during color copying, when toner images in four colors, namely black, yellow, magenta and cyan, are superposed in sequence onto the intermediate transfer belt. When a position error is generated due to an external disturbance or the like, the error appears as color shift. In other words, when position control is performed, a target position can be reached after color shift occurs at a certain point in time. With the conventional speed control described above, on the other hand, color shift cannot be corrected once a position error has occurred.

To improve control in the sub-scanning direction, Japanese Unexamined Patent Application Publication 2003-241535 proposes a technique for reducing belt speed fluctuation such as bounding and positional deviation from a target belt position, and preventing color shift in a formed image such that high-quality images are formed. In this technique, a belt surface target position command 1 is converted directly into a drive shaft target position (angle). A belt surface target position command 2 is compared with a belt surface position (target surface position) by comparison means 301, whereupon the deviation therebetween is calculated by surface position control means 302, converted into a drive shaft target position (angle), and added to the command 1 by addition means 303. A deviation between the drive shaft target position (angle) and a drive shaft angle is obtained by comparison means 304, calculated by position control means 305, and applied to a drive subject motor as a current, whereby the drive subject is driven to follow a target position. According to this publication, a belt moving device that is capable of reducing belt speed fluctuation such as bounding and positional deviation from a target belt position and preventing color shift in an image formed by the device such that high-quality images are formed can be provided.

Next, an embodiment of the present invention for solving the problems in the related art described above will be described in detail.

Figure 7:
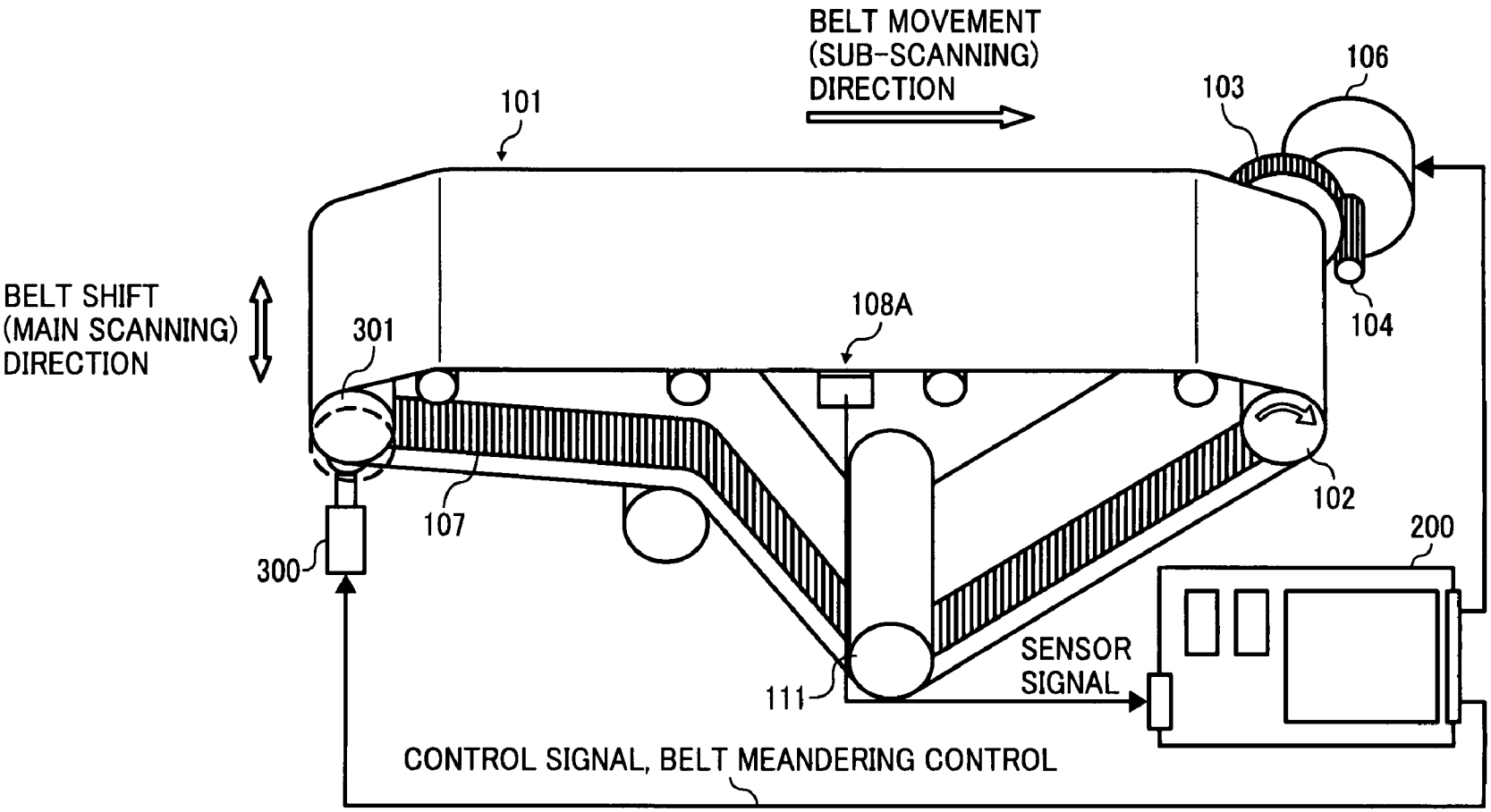
FIG. 7 is a perspective view showing the overall constitution of a belt moving device according to an embodiment of the present invention.

FIG. 7 shows the schematic constitution of a belt moving device according to this embodiment.

As shown in the drawing, this belt moving device comprises an endless belt 101 serving as a drive subject. A 2D measurement pattern 107 is formed in a predetermined position on the rear surface of the endless belt. The endless belt 101 is wrapped around and stretched by a drive roller 102 for moving or stopping the endless belt 101, a movable roller 301 configured to be capable of moving in the vertical direction of the drawing, and a plurality of support rollers (driven shafts) 111. The endless belt 101 is connected to a sub-scanning motor 106 serving as a drive source via a transfer system including the drive roller 102 and its shaft (drive shaft), a drive shaft gear 103, a motor shaft gear 104, and so on, and is driven in the movement (sub-scanning) direction by the sub-scanning motor 106.

Further, a 2D sensor 108A is disposed within the inner periphery of the endless belt 101 so as to face the 2D measurement pattern 107 on the endless belt 101 and read signals therefrom. The 2D sensor 108A is capable of detecting the position of the endless belt 101 in a belt shift (main scanning) direction and the belt movement (sub-scanning) direction. Calculations for controlling the endless belt 101 are implemented by a controller 200, and main scanning direction control is performed by driving roller moving means (also referred to as moving means) 300. Sub-scanning direction control is performed by driving the sub-scanning motor 106. Further, a belt drive shaft encoder (detection sensor; not shown) for detecting the rotation of the drive shaft 102 is attached to one end of the drive roller 102.

Here, the transfer mechanism for transferring the driving force of the belt moving device is constituted by gears, but a transfer mechanism constituted by a timing belt or a direct mechanism in which a motor is directly connected to the drive subject may also be employed.

Figure 8:
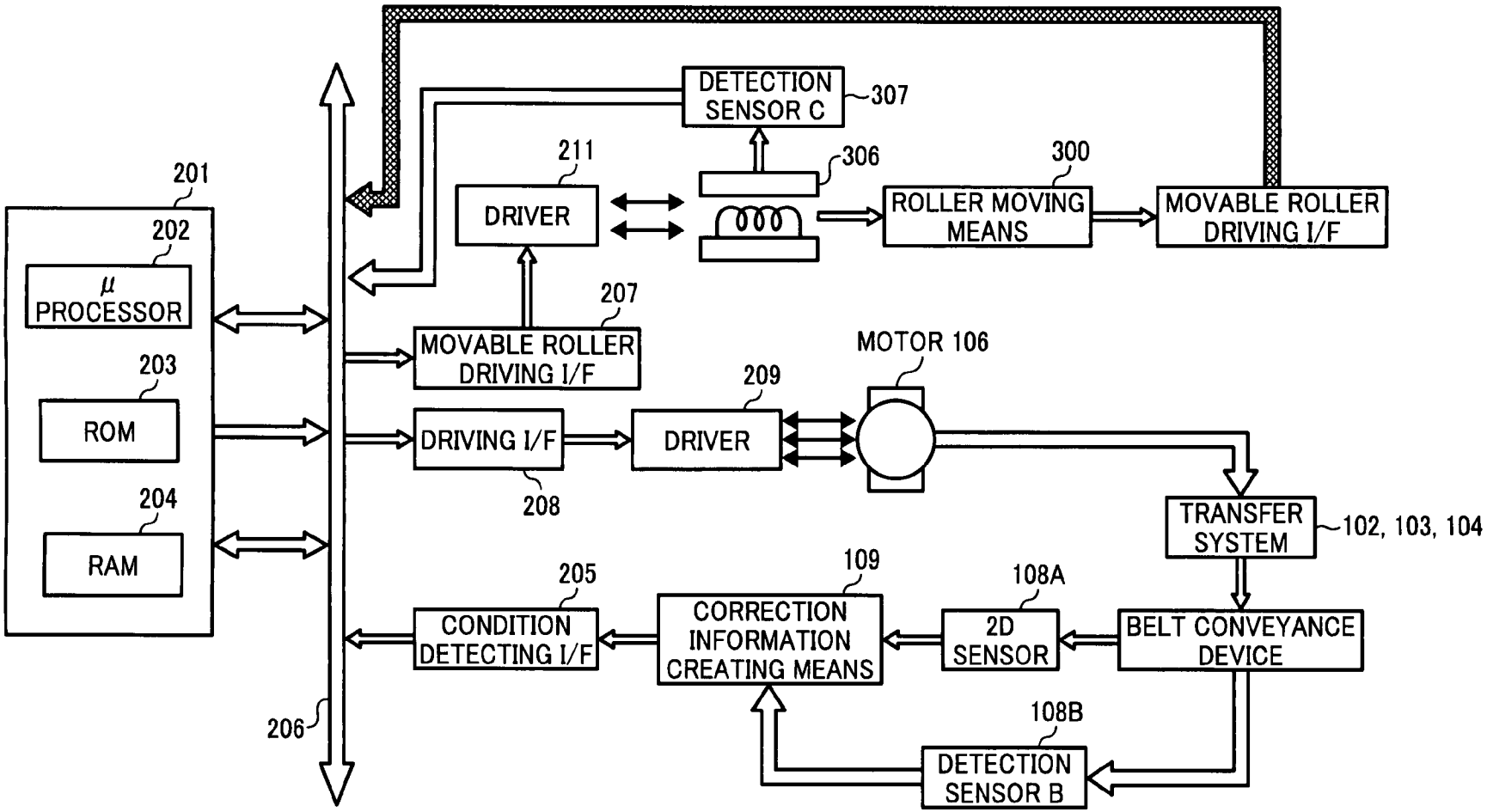
FIG. 8 is a block diagram showing a driving system of a moving mechanism for an endless belt in the belt moving device.

Next, the hardware configuration of the controller 200 will be described with reference to FIG. 8.

First, a microcomputer 201 responsible for overall control is provided. The microcomputer 201 is responsible for control of the entire moving mechanism. A microprocessor (CPU) 202, read-only memory (ROM) 203, and random access memory (RAM) 204 are respectively connected to the microcomputer 201 via a bus.

Further, sensor output corresponding to movement of the 2D measurement pattern 107 from the 2D sensor (main scanning sensor and sub-scanning sensor) 108A is input into the microcomputer 201 via correction information creating means 109, a condition detecting interface 205, and a bus 206. Here, the condition detecting interface 205 processes a marker output count (rough counter) and a signal interpolation clock count (close counter) from the correction information creating means 109 as well as the count of a drive shaft encoder 108B (detection sensor B), and converts the counts into digital numerical values. Thus, the condition detecting interface 205 has a function for counting a pulse count. At this time, the condition detecting interface 205 may also have a function for using origin (home position) information held by the correction information creating means 109 to form an association (correlation) with the movement position of the endless belt 101.

Further, the sub-scanning motor 106 is connected to the microcomputer 201 via the bus 206, a driving I/F 208, and a driver 209. Driving I/Fs 208, 210 convert a digital signal of a calculation result from the microcomputer 201 into an analog signal, apply the analog signal to motor driving drivers 209, 211 serving as driving devices, and thereby control the current and voltage that are applied to the sub-scanning motor 106. As a result, the endless belt 101 is driven to follow a predetermined target position. The position of the endless belt 101 at this time is detected by the condition detecting interface 205 via the correction information creating means 109 as the sub-scanning sensor output of the 2D measurement pattern 107, and downloaded to the microcomputer 201. When the interval of the 2D measurement pattern 107 is wide, the correction information creating means 109 may perform positional interpolation within the interval of the 2D measurement pattern 107 using a clock.

The 2D sensor (main scanning sensor and sub-scanning sensor) 108A is also capable of detecting the position in a belt shift direction (main scanning direction). The detected position information is downloaded to the microcomputer 201, where a belt shift direction control calculation is performed, and then pressing means (an actuator) 306 are driven by the driver 211 via a movable roller driving interface 207 to drive the movable roller 301 in the vertical direction. A detection sensor 307 detects the position of the movable roller 301 and obtains position information (a movable roller angle) for driving the movable roller. A linear motor is used as the pressing means 306, and a linear sensor attached to the linear motor is used as the detection sensor 307. However, a rotary motor and a device that moves [the motor] linearly using a cam may be used for these parts[i]. Further, the period and phase of offset during a single revolution of the roller may be detected by a sensor that detects the rotary angle of the movable roller 301.

A position control method of the belt moving device according to this embodiment is executed by the calculation processing function of the microcomputer 201, as described above. Needless to say, however, a DSP (digital signal processor) having a higher numerical processing capacity may be used instead of the microcomputer 201.

Figure 9A:
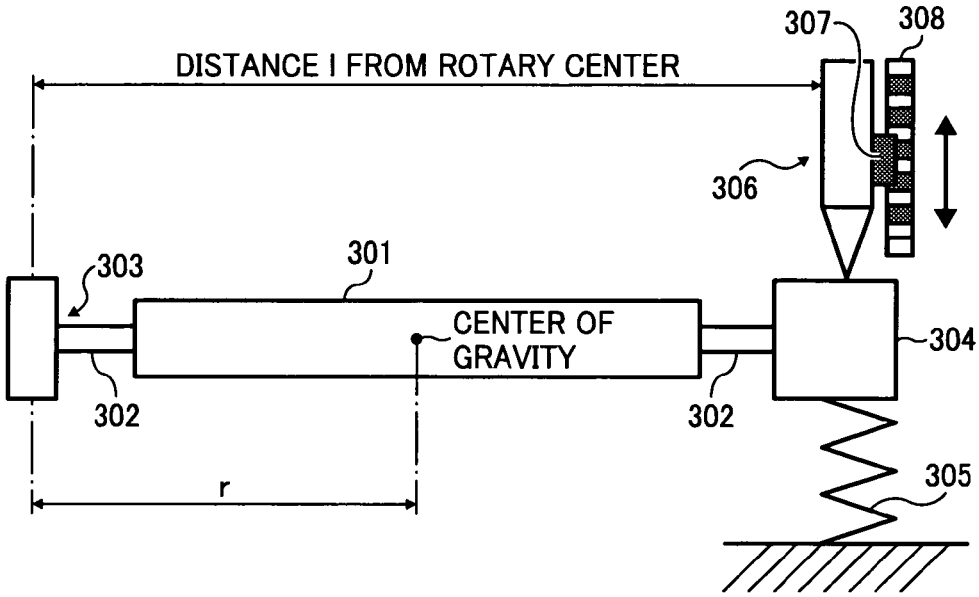
FIGS. 9A and 9B are views illustrating the constitution and operation of a moving means part of the belt moving device.
Figure 9B:
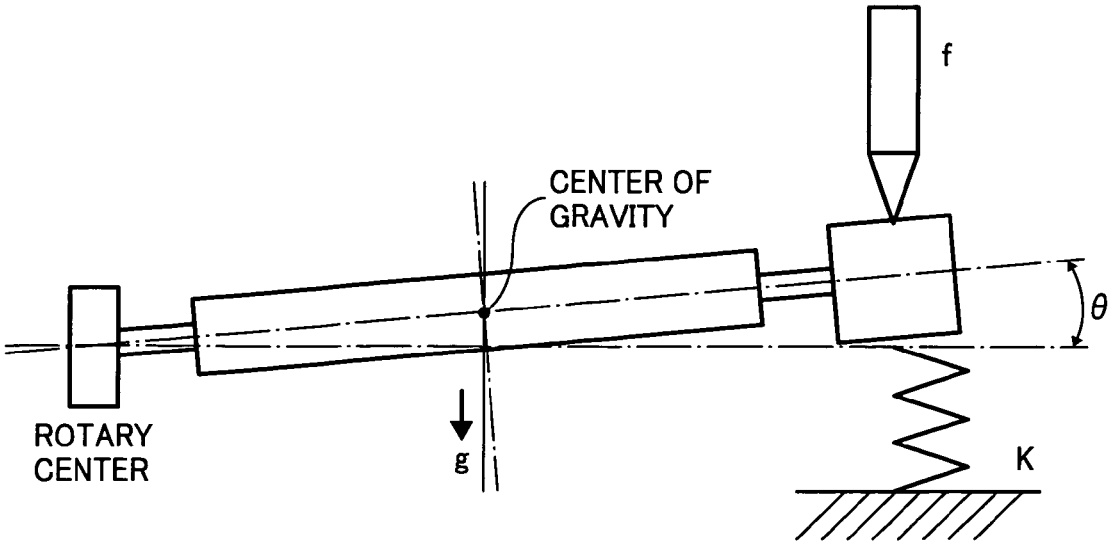

Next, referring to FIGS. 9A and 9B, a position control method executed by belt shift control means according to this embodiment will be described in further detail. FIG. 9A shows a state in which the movable roller 301 is parallel to the drive roller (drive shaft) 102, and FIG. 9B shows a state in which the movable roller 301 is not parallel to the drive roller 102.

In the movable roller 301, a movable roller shaft 302 serving as a shaft of the movable roller 301 is supported rotatably at one end by a self-aligning bearing 303 and at the other end by a bearing holder 304. The bearing holder 304 is biased in one direction by spring means 305 and contacted on the opposite side by the pressing means (actuator) 306 constituted by a linear motor or the like. As the pressing means 306 move in the vertical direction, the movable roller 301 rotates (pivots) about the self-aligning bearing 303 such that the angle thereof (the movable roller angle) varies from a predetermined movable roller 301 position (an initial position, for example).

When the movable roller 301 is parallel to the drive roller (drive shaft) 102, as shown in FIG. 9A, shifting does not occur in the endless belt (not shown) even if the endless belt moves. The rotary center of the movable roller 301 is the self-aligning bearing 303. The bearing holder 304 is moved in the vertical direction of the drawing by the spring and the pressing means 306 constituted by a linear motor or the like. On the other hand, when the movable roller 301 is not parallel to the drive roller 102, as shown in FIG. 9B, shifting occurs in the endless belt when the endless belt moves. Hence, the roller moving means 300 apply a drive signal to the pressing means (actuator) 306 of the movable roller 301 via a driver to move the movable roller 301 in the vertical direction and thereby eliminate the effect of the endless belt shifting.

Here, the transfer characteristic of the roller moving means 300 according to this embodiment is illustrated by the following formulae. The optimum position of the movable roller (optimum roller position) at this time is set at $\theta=0$. Belt shifting is thus eliminated.

$$Id^2\theta/dt^2=fl\cos\theta+mgl\cos\theta-Kxl\cos\theta-bd\theta/dt \quad \text{Eq. (1)}$$

where I is a moment of inertia, f is the force of the actuator, l is the distance from the rotary center, m is the weight of the rotary part, K is a spring constant, b is a viscous braking coefficient, g is gravitational acceleration, and $\theta$ is the angle of the movable roller.

$$x=l\sin\theta \quad \text{Eq. (2)}$$

$$I=mr^2 \quad \text{Eq. (3)}$$

When $\theta\cong 0$, $x\cong l\theta$ $\cos\theta\cong 1$

Equation (1) is as follows.

$$Id^2\theta/dt^2=fl+mgl-Kl\theta l-b\theta/dt \quad \text{Eq. (4)}$$

When Equation (4) is subjected to Laplace transform, the dynamics of the moving means are as shown in Equation (5).

$$Is^2\Theta(s)=F(s)l+mgl-Kl^2\Theta(s)-bs\Theta(s)$$

$$\Theta(s)(Is^2+Kl^2+bs)=F(s)l+mgl$$

$$\Theta(s)=1/Is^2+bs+Kl^2(F(s)l+mgl) \quad \text{Eq. (5)}$$

Further, the belt shifting variation rate is as shown in Equation (6).

$$dy/dt=A\theta \quad \text{Eq. (6)}$$

where y is the belt shift position, and A is a constant determined by the belt traveling speed.

Figure 10A:
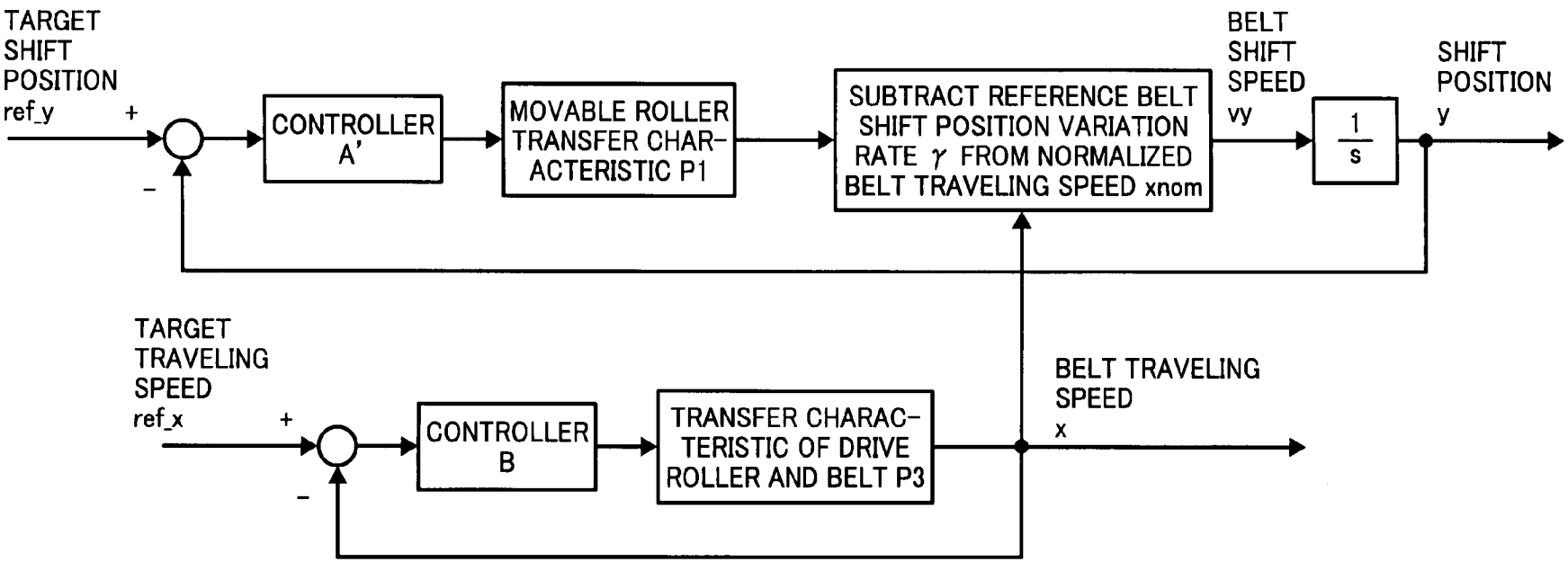
FIGS. 10A and 10B are block diagrams showing constitutions relating to drive subject position control.

Position control according to this embodiment will now be described with reference to the block diagrams in FIGS. 10A and 10B.

The belt shift position y is subtracted from a target shift position ref_y. The deviation therebetween is calculated by a controller A'. The calculation result is supplied to the movable roller driving actuator. The belt shift position variation rate is determined according to the movable roller angle and the value of the belt traveling speed, and thus a belt shifting speed vy is determined. By integrating the belt shifting speed vy, the belt shift position is determined. In this case, the shifting amount of the endless belt per unit time may be determined in advance by moving the belt at a constant speed in a state where the position of the movable roller is fixed in a vertical direction target rotation position.

Belt shift control will now be described in detail.

Figure 11A:
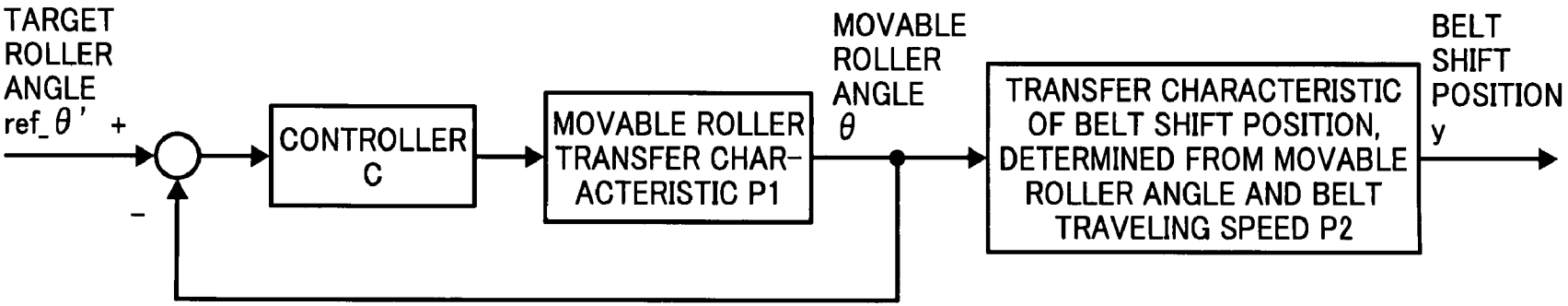
FIGS. 11A to 11C are block diagrams showing a transfer characteristic of a movable roller.
Figure 11B:
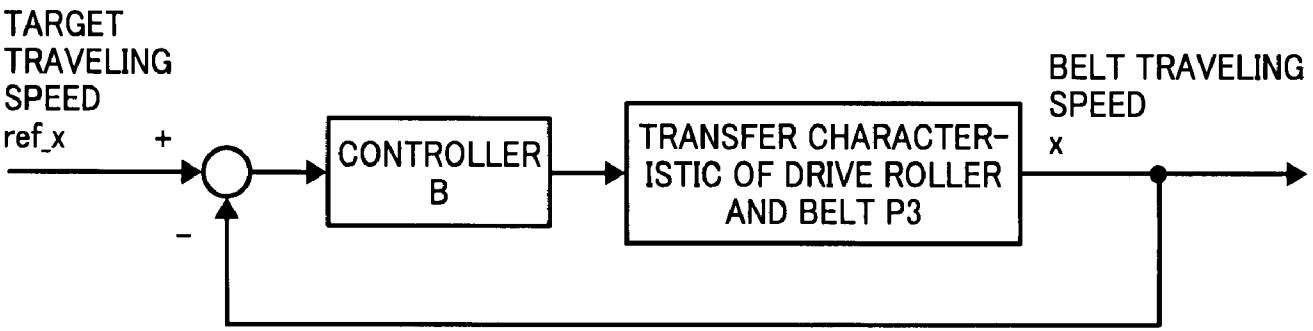
Figure 11C:
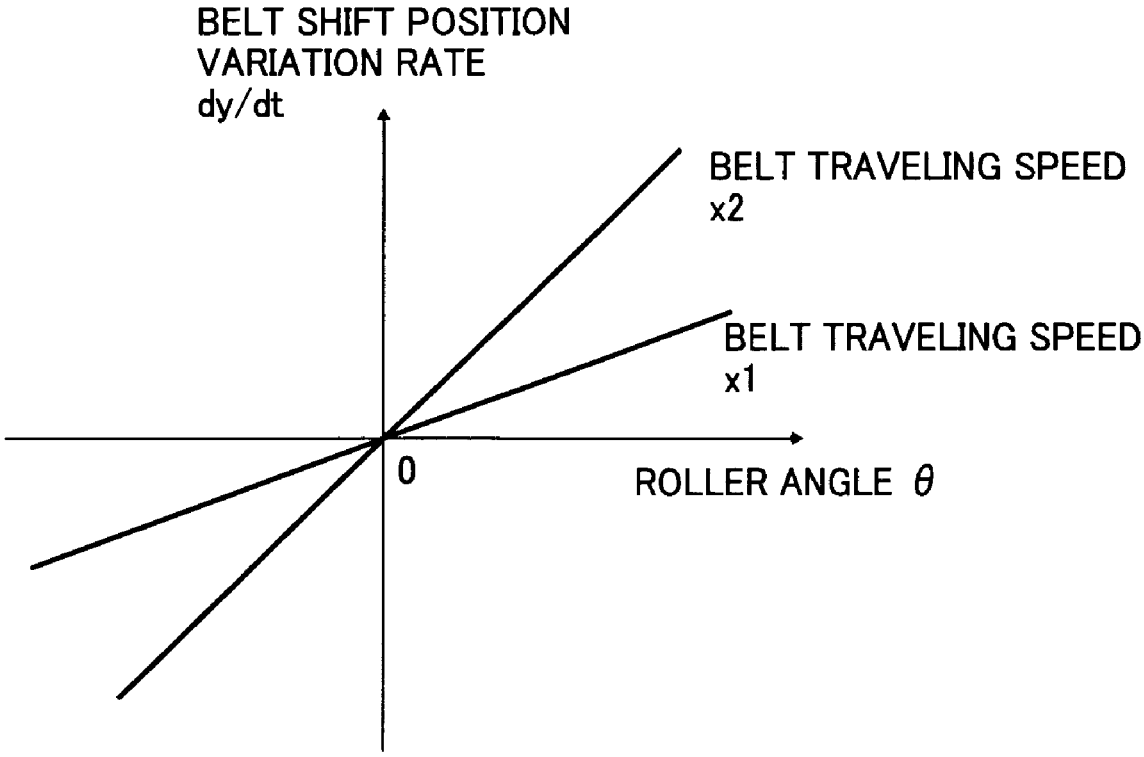

FIGS. 11A to 11C are block diagrams and soon illustrating the transfer characteristic of the movable roller. FIG. 11A is a block diagram showing control performed by a controller C to fix the roller angle, and FIG. 11B is a block diagram showing control of the belt traveling speed by a controller B. The roller angle and the belt shift position variation rate dy/dt are determined by moving the belt at a constant speed. FIG. 11C is an illustrative view showing that the belt shift position variation rate dy/dt is dependent on the belt traveling speed.

Figure 12:
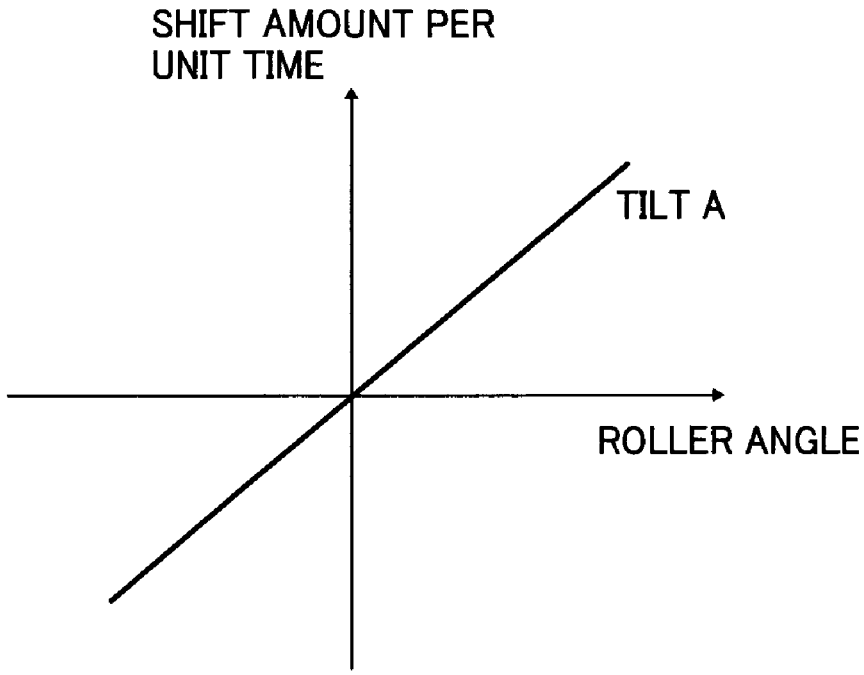
FIG. 12 is a view illustrating belt shifting behavior.
Figure 12:
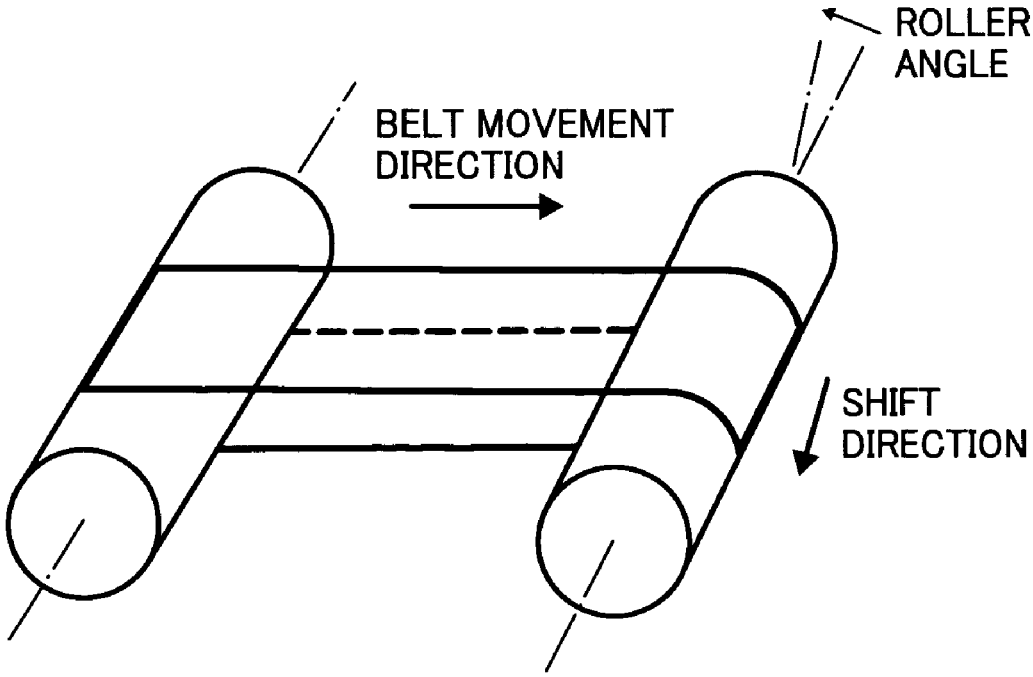

FIG. 12 is an illustrative view showing the behavior of belt shifting. Belt shifting occurs when two rollers are at an angle and the belt moves. The shifting amount per unit time is determined according to the roller angle. As shown in FIG. 12, by determining the belt traveling speed, the belt shifting amount per unit time occurring in accordance with the roller angle can be learned, and therefore, by controlling the angle of the movable roller to an angle at which the shifting amount reaches zero, belt position deviation in the main scanning direction can be corrected.

In this embodiment, the shifting amount of the intermediate transfer belt (endless belt) per unit time is determined in advance by moving the belt at a constant speed in a state where the angle (position) of the movable roller is fixed in a vertical direction target rotation position. Then, by controlling the angle of the movable roller on the basis of a value determined as described above corresponding to the belt traveling speed, belt shifting is prevented. When the belt is moved with a high degree of horizontal direction positional precision in this manner and this movement is applied to the intermediate transfer belt, a high-quality formed image with no color shift is obtained. Note that when the traveling speed is near zero, the calculation result of the controller is divided by zero, causing instability in the control system. When a determined value is used, however, stable position control can be realized.

A procedure for detecting the optimum roller position according to this embodiment will now be described using the flowchart in FIG. 13.

First, the initial position of the movable roller 301 is set such that the gravitational force applied to the movable roller 301 is counterbalanced by the spring 305. The initial position of the movable roller 301 is set as r0. From this position (S12), movement control of the endless belt 101 is performed, and measurement of the belt shifting amount is begun (S13) at a constant speed (S11). When the endless belt 101 completes a single round trip (YES in S14), measurement of the belt shifting amount is terminated (S15). Needless to say, measurement is not limited to a single round trip of the belt, and the belt shifting amount may be determined by measuring belt movement over n round trips.

Next, the roller moving means 300 move the movable roller 301 from the initial position to a point A position (S16). Belt movement control is then performed in this position, and measurement of the belt shifting amount is begun at a constant speed (S17). When the endless belt completes a single round trip (YES in S18), measurement of the belt shifting amount is terminated (S19). Needless to say, the shifting amount may be determined by measuring belt movement over n round trips.

Next, the optimum roller position of the movable roller 301 is determined through calculation (S1*a*). This will be described in detail below using FIGS. 14A to 14D.

Once the optimum roller position of the movable roller 301 has been determined, the movable roller 301 is moved to the optimum roller position, and feedback control is performed to hold the movable roller 301 in the optimum roller position. When belt movement control is performed in the optimum roller position (S1*b*), belt shifting can be suppressed.

Next, using FIGS. 14A to 14D, 15 and 16, a method of determining the optimum roller position of the movable roller 301 will be described. Here, it is assumed that when the movable roller 301 is in the optimum roller position, belt shifting is zero.

Figure 14A:
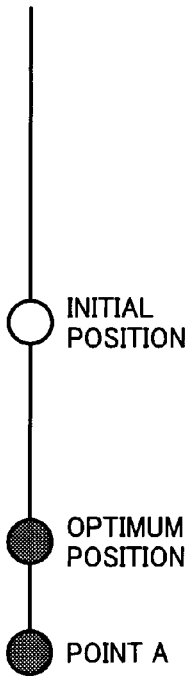
FIGS. 14A to 14D are views showing positional relationships of the movable roller when detecting the optimum roller position.
Figure 14B:
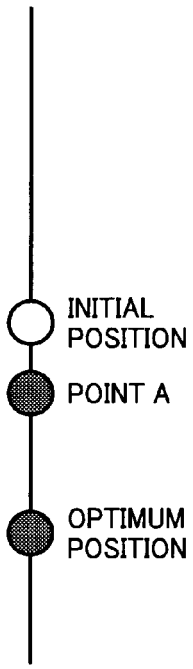
Figure 14C:
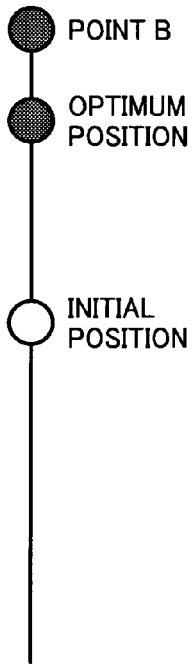
Figure 14D:
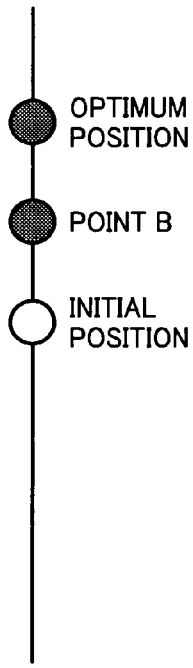

FIGS. 14A to 14D show the vertical position (roller position) of the movable roller 301 at the end portion on the bearing holder 304 side. The white circles in the drawings denote the initial position of the movable roller 301, and the optimum position of the movable roller 301 (indicated by the black circles in the drawings) is either above or below the initial position, depending on the assembled state of the belt moving device. More specifically, FIGS. 14A and 14B show cases in which the initial position of the movable roller 301 is above the optimum position, while FIGS. 14C and 14D show cases in which the initial position of the movable roller 301 is below the optimum position.

When the movable roller 301 is above the optimum position, the endless belt 101 shifts in a certain single direction (+direction, for example) as it moves, and when the movable roller 301 is below the optimum position, the endless belt 101 shifts in the opposite direction (− direction).

The point A in FIG. 14A is a point to which the movable roller 301 is moved in the downward direction from the initial position. When the endless belt 101 is move data constant speed, the movable roller 301 moves too far downward from the optimum position, and therefore the endless belt 101 shifts in the − (minus) direction. The point A in FIG. 14B is also a point to which the movable roller 301 is moved in the downward direction from the initial position. When the endless belt 101 is moved at a constant speed, the movable roller 301 does not reach the optimum position, and therefore the endless belt 101 shifts in the + (plus) direction. However, the belt shifting amount is smaller than the belt shifting amount when the movable roller 301 is in the initial position.

The point B in FIG. 14C is a point to which the movable roller 301 is moved in the upward direction from the initial position. When the endless belt 101 is moved at a constant speed, the movable roller 301 moves too far upward from the optimum position, and therefore the endless belt 101 shifts in the + (plus) direction. The point B in FIG. 14D is also a point to which the movable roller 301 is moved in the upward direction from the initial position. When the endless belt 101 is moved at a constant speed, the movable roller 301 does not reach the optimum position, and therefore the endless belt 101 shifts in the − (minus) direction. However, the belt shifting amount is smaller than the belt shifting amount when the movable roller 301 is in the initial position.

Figure 15:
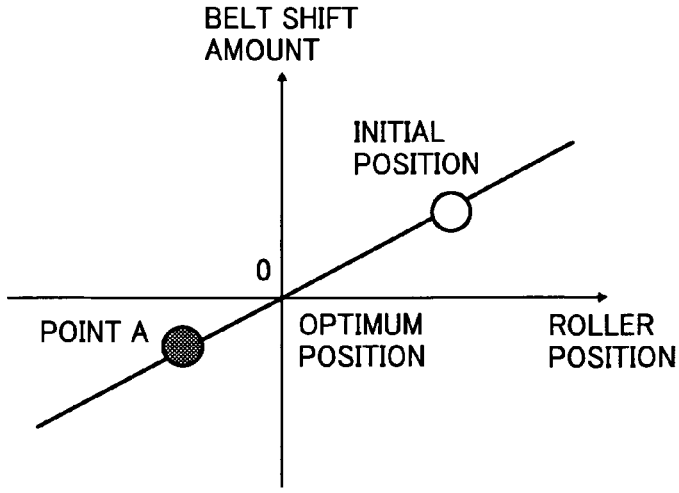
FIG. 15 is a view showing a relationship between the movable roller and a belt shifting amount.

FIG. 15 shows the relationship between the vertical position (roller position) of the movable roller 301 and the belt shifting amount. When the movable roller 301 is in the optimum position (when the roller position in the drawing is zero), the belt shifting amount reaches zero and is set at the origin in the drawing. When the roller position and belt shifting amount are plotted, they form a straight line passing through the origin. In FIG. 15, when the initial roller position is above the optimum position and the endless belt 101 is moved, the endless belt 101 shifts in the +direction. The point A in the drawing is the point to which the movable roller 301 is moved downward from the optimum position. In this case, when the endless belt 101 is moved at a constant speed, the movable roller 301 moves too far downward from the optimum position, and therefore the endless belt 101 shifts in the − (minus) direction. Hence, if the initial position of the movable roller 301, the belt shifting amount at the initial position, the position of the point A, and the belt shifting amount at the point A are known, the optimum position can be determined through calculation.

Figure 13:
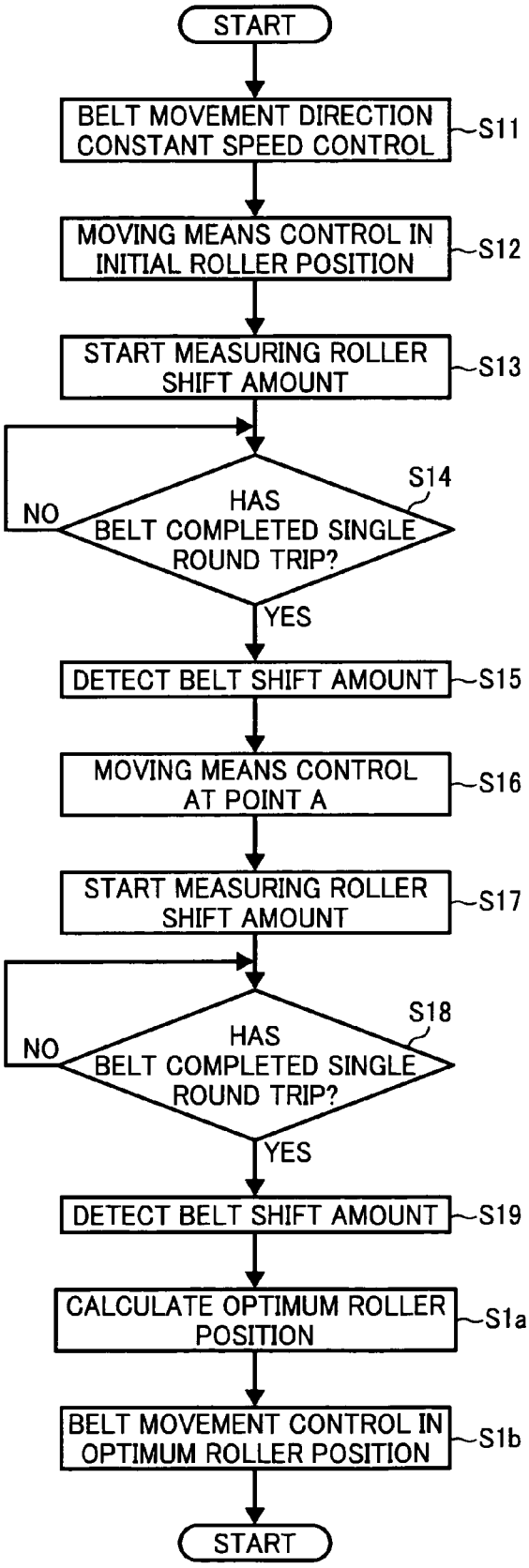
FIG. 13 is a flowchart showing a procedure for detecting an optimum roller position.

In terms of the flowchart shown in FIG. 13, first the initial position of the movable roller 301 is set such that the gravitational force applied to the movable roller 301 is counterbalanced by the spring 305. The initial position of the movable roller 301 is set as r0. From this position, belt movement control is performed, and measurement of the belt shifting amount is begun at a constant speed. When the endless belt 101 completes a single round trip or a plurality of round trips (n round trips), measurement of the belt shifting amount is terminated.

Considering a case in which the endless belt 101 performs a single round trip, when the belt traveling speed is Vb, the belt circumference is Db1, the belt shifting amount during one round trip is Xb1r0, and the belt shifting speed is V×b1r0, for example, the following equation is obtained.

$$V\times b1r0=Xb1r0/(Db1/Vb) \quad \text{Eq. (7)}$$

Considering a case in which the endless belt 101 performs n round trips, when the belt shifting amount during n round trips is Xbnr0, and the belt shifting speed is V×bnr0, the following equation is obtained.

$$V\times bnr0=Xbnr0/(n\times Db1/Vb) \quad \text{Eq. (8)}$$

Figure 16:
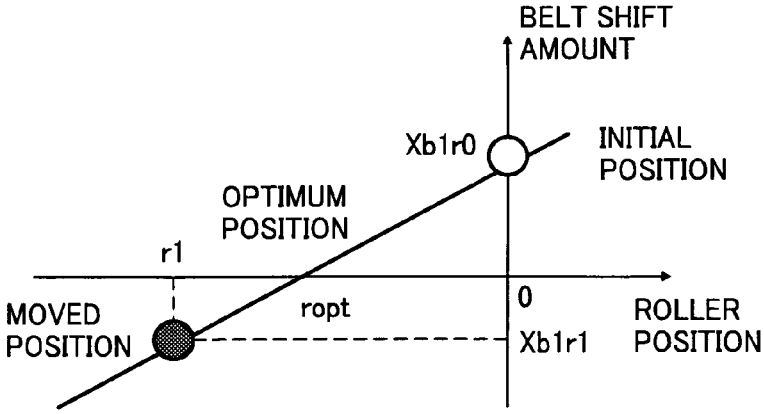
FIG. 16 is a view showing the relationship between the movable roller and the belt shifting amount when determining the optimum roller position.

Next, a method of determining the optimum roller position will be described with reference to FIG. 16.

It is assumed that the position to which the movable roller 301 moves from the initial roller position r0 is r1. From this position, belt movement control is performed, and measurement of the belt shifting amount is begun at a constant speed. When the belt completes a single round trip, measurement of the belt shifting amount is terminated. Needless to say, the shifting amount may be determined by measuring n round trips and determining the belt shifting speed relative to the belt traveling speed.

When the belt shifting amount during one round trip is Xb1r1, the initial roller position is r0, and the initial roller position r0=0, the relationship between the belt shifting amount Xb and the roller position r is as shown in the following equation.

$$Xb=(Xb1r0-Xb1r1)/(0-r1)\times r+Xb1r0 \quad \text{Eq. (9)}$$

At this time, an optimum roller position ropt is located at the point where Xb=0, and therefore the following relationship is obtained.

$$Ropt=-Xb1r0/(Xb1r0-Xb1r1)/(0-r1) \quad \text{Eq. (10)}$$

Figure 17:
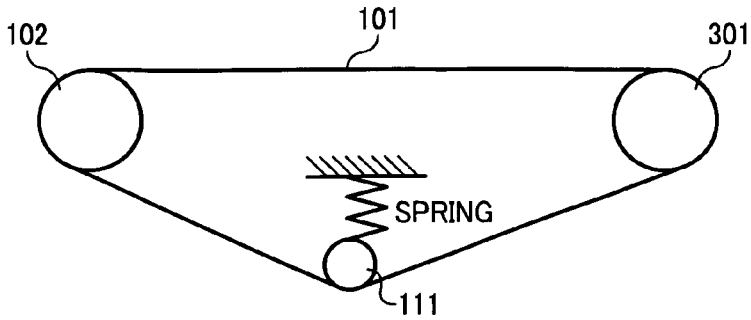
FIG. 17 is a view illustrating a relationship between the endless belt and the circumference of the roller.

FIG. 17 shows one example of the layout of the endless belt 101 and the movable roller 301. Assuming that the drive roller 102 and movable roller 301 each have a diameter ϕ of 30 mm, a tension roller 111 has a diameter ϕ of 15 mm, and the belt circumference of the endless belt 101 is 942 mm, the belt circumference is ten times the circumference of the drive roller 102 and movable roller 301 and twenty times the circumference of the tension roller 111, and is therefore an integral multiple. In this case, when belt shifting following a single round trip of the endless belt 101 is measured, the effect of belt shifting caused by roller offset can be eliminated.

Figure 18:
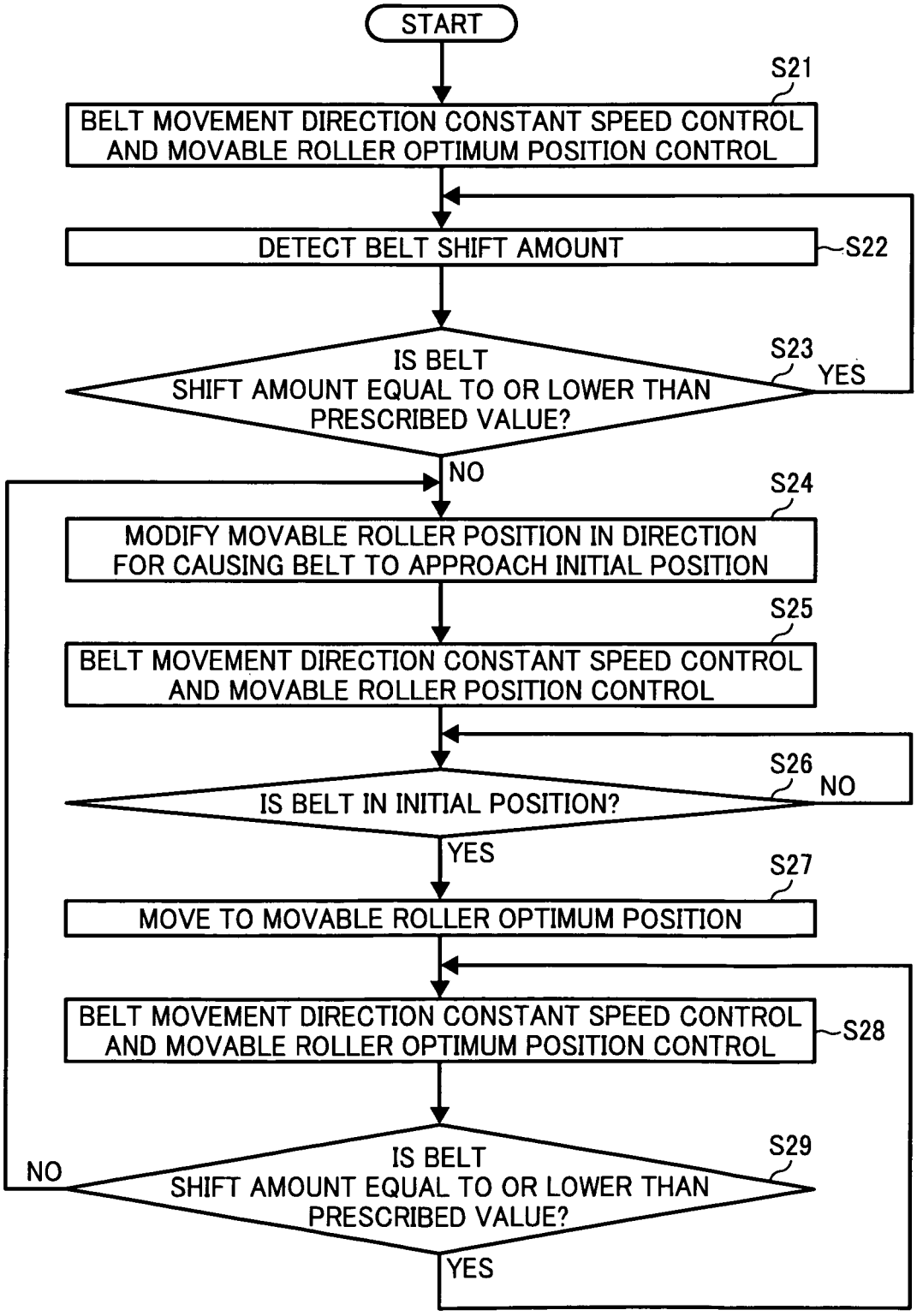
FIG. 18 is a flowchart relating to position control when the endless belt deviates from a predetermined position.

FIG. 18 is a flowchart relating to position control when the endless belt 101 deviates from a predetermined position. In actuality, even when the movable roller 301 is in the optimum position, the shifting amount of the endless belt 101 exceeds a prescribed shifting value little by little after many round trips. Hence, the endless belt 101 must be returned to the initial position in the main scanning direction.

First, belt movement direction constant speed control and movable roller optimum position control are implemented (S21). Next, the belt shifting amount is detected by the 2D sensor 108A (S22). When the belt shifting amount is equal to or smaller than the prescribed value (Yes in S23), movement control of the endless belt 101 (belt movement direction constant speed control) is continued. When the belt shifting amount exceeds the prescribed value (No in S23), movement control of the endless belt 101 (belt movement direction constant speed control) is stopped, and the movable roller position is moved in a direction for causing the endless belt 101 to approach the initial position (S24). In this position, belt movement direction constant speed control and movable roller position control are performed (S25).

Next, when the endless belt 101 reaches the initial position in the main scanning direction (Yes in S26), movement control of the endless belt 101 is stopped, and the movable roller 301 is moved to the optimum position (S27). In this position, belt movement direction constant speed control and movable roller optimum position control are performed (S28).

The belt shifting amount is then detected by the 2D sensor 108A, and when the belt shifting amount exceeds the prescribed value (No in S29), the control of the step S24 onward for modifying the position of the movable roller 301 is repeated.

The belt shift control means are configured to include an integrator for integrating feedback signals serving as information relating to the detected roller position of the moving means, and comprise a controller for controlling the moving means 300 to fix the roller position of the moving means 300.

This constitution will now be described using FIGS. 19, 20A and 20B.

The following equation illustrates the transfer characteristic of the movable roller.

An input u corresponds to u=F(s)l+mgl in Equation (5) and the output corresponds to the roller angle Θ(s).

$$\text{A transfer function} G_\theta=1/Is^2+bs+Kl^2 \quad \text{Eq. (11)}$$

$$dy/dt=A\theta \quad \text{Eq. (6)}$$

where y is the belt shift position, and A is a constant determined by the belt traveling speed.

A is set at y when the belt traveling speed is 0.1 m/s.

Figure 19:
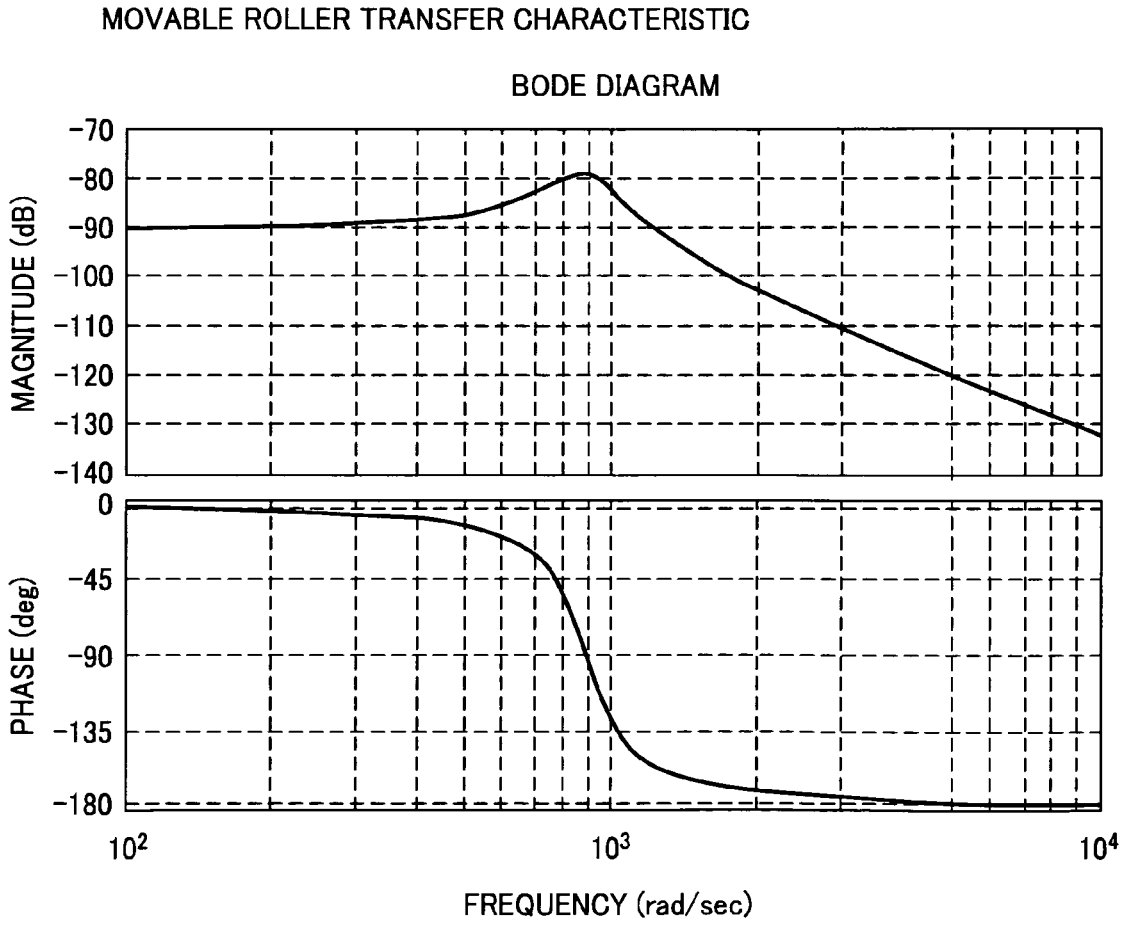
FIG. 19 is a Bode diagram of the transfer characteristic of the movable roller.

FIG. 19 is a Bode diagram showing the transfer characteristic of the movable roller. A spring system (the spring means 305) is provided in the roller moving means 300, and therefore a resonance system is obtained.

Figure 20A:
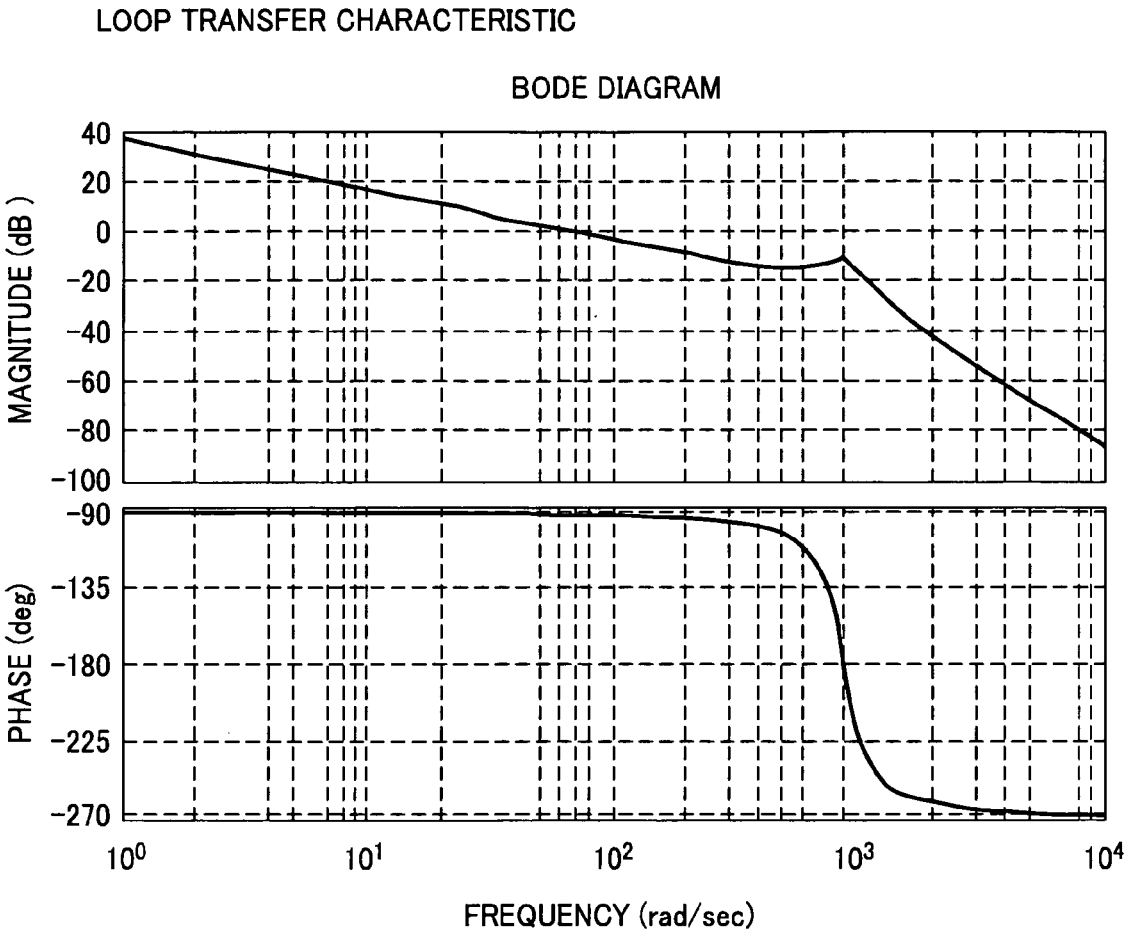
FIGS. 20A and 20B are views showing a loop transfer characteristic of a controller including an integrator.
Figure 20B:
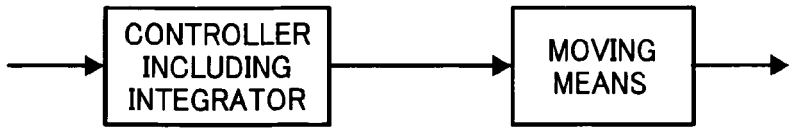

FIG. 20A shows a loop transfer characteristic of the controller including the integrator, and FIG. 20B is a block diagram thereof.

Figure 21A:
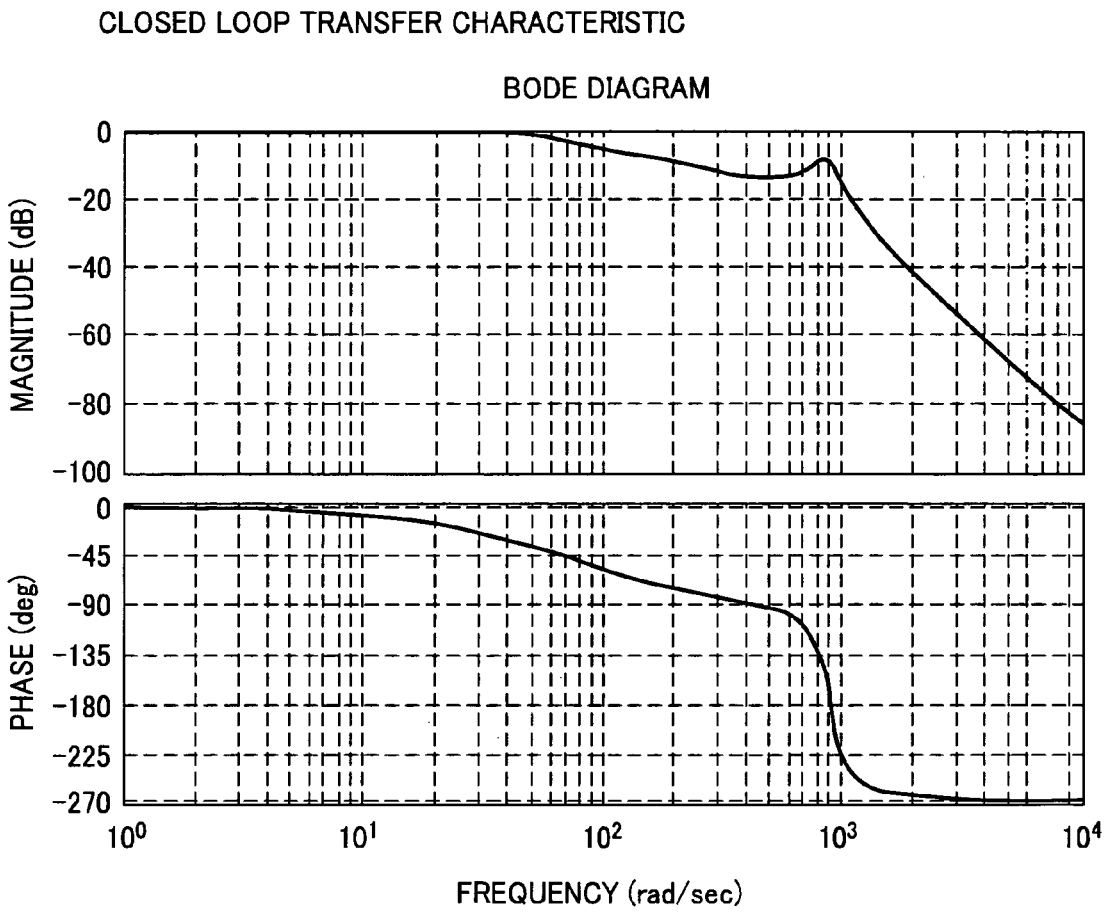
FIGS. 21A and 21B are views showing a closed loop transfer characteristic from a target roller angle to a movable roller angle.
Figure 21B:
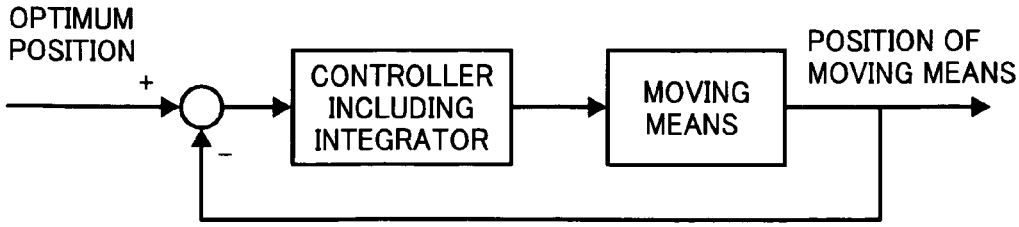

FIG. 21A shows a closed loop transfer characteristic from a target roller angle to the movable roller angle, and FIG. 21B is a block diagram thereof.

Figure 22A:
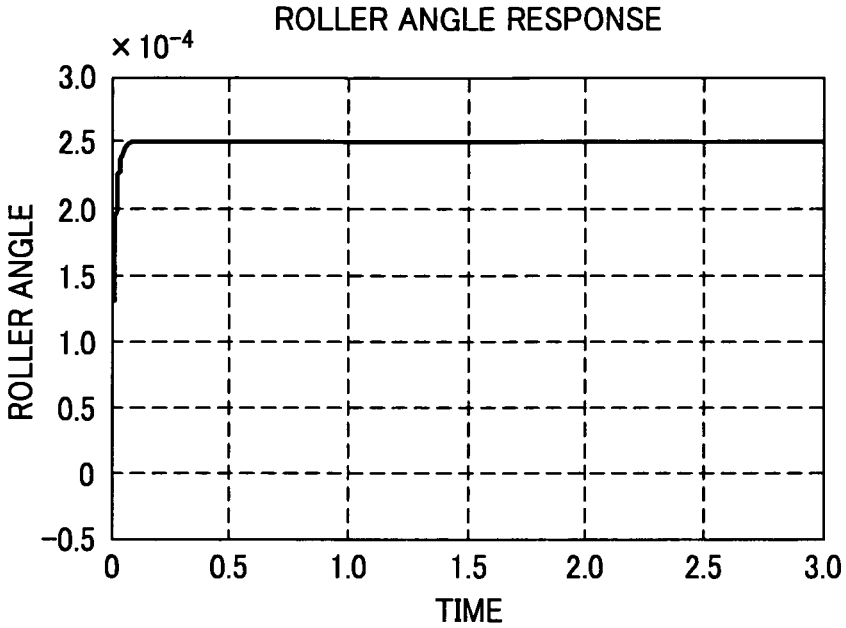
FIG. 22A is a view showing the time response of the roller angle.
Figure 22B:
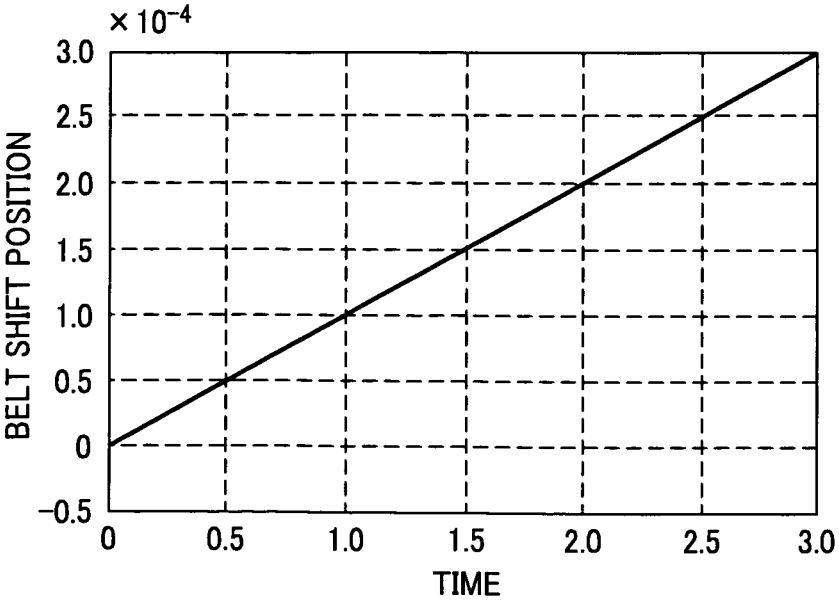
FIG. 22B is a view showing the time response of a belt shift position under identical conditions.

FIG. 22A is a view showing the time response of the roller angle when the belt traveling speed is 0.4 m/s and the target roller angle is 2.5 e-4 radians, in which a target value is matched. FIG. 22B is a view showing the time response of the belt shift position under the same conditions. A deviation of 100 μm occurs per second. Thus, a deviation of 100 μm occurs every second at a reference traveling speed of 0.4 m/s and a reference roller angle of 2.5 e-4 radians.

Figure 23:
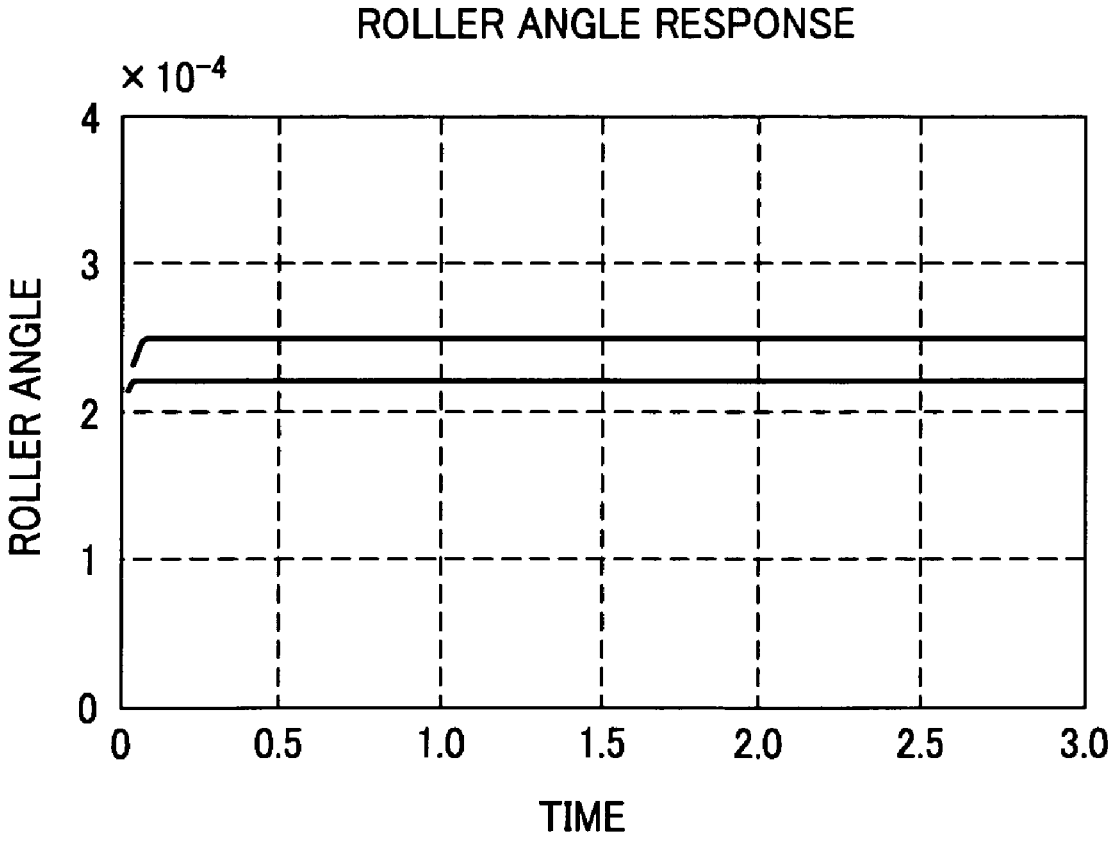
FIG. 23 is a view showing the respective time responses of the roller angle when the integrator is present and absent.

FIG. 23 is a view showing the roller angle time response of a controller including an integrator and the roller angle time response of a controller not including an integrator when the belt traveling speed is 0.4 m/s and the target roller angle is 2.5 e-4 radians. When the controller does not include an integrator, positional deviation occurs in relation to the reference roller angle of 2.5 e-4 radians, and as a result it becomes impossible to follow the target value.

Figure 24A:
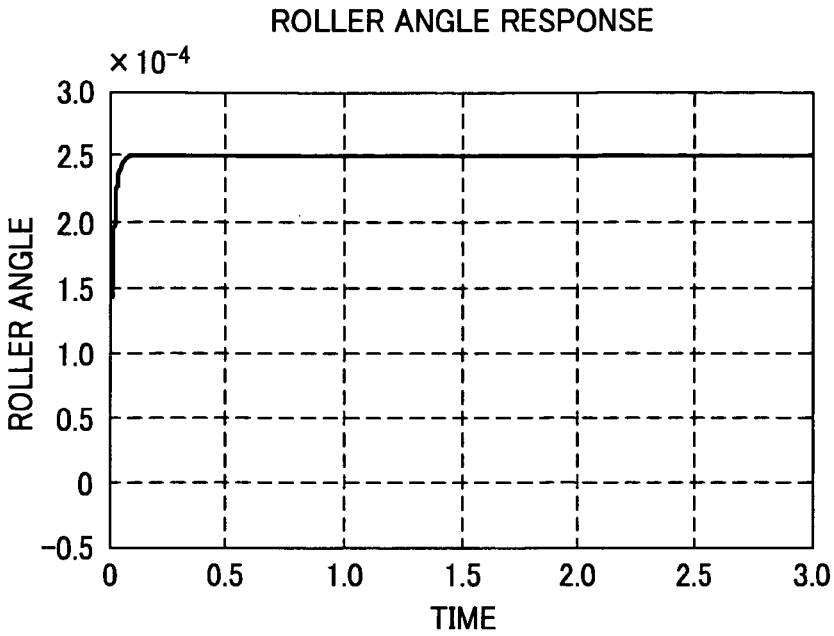
FIGS. 24A and 24B are examples of response when belt shift control is performed according to this embodiment.
Figure 24B:
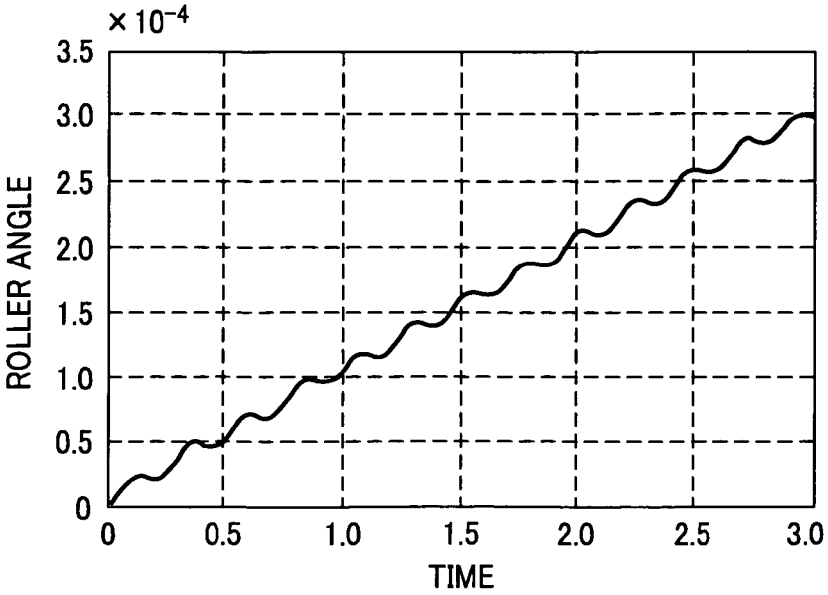

FIGS. 24A and 24B show behavior of the endless belt caused by roller offset.

FIG. 24A is a view showing the roller angle time response when the belt traveling speed is 0.4 m/s and the target roller angle is 2.5 e-4 radians, in which the target value is matched. FIG. 24B is a view showing the time response of the belt shift position under the same conditions, in which the endless belt shifts while meandering due to roller offset.

In this case, the roller offset frequency is 4.2441 Hz, and the time required for the endless belt to perform a single round trip is 2.355 seconds. Thus, the roller circumference and the belt circumference are integral multiples. Hence, by measuring the belt shifting amount in a single round trip, measurement errors caused by roller offset can be ignored.

Further, the belt shift control means comprise a controller for controlling the movement direction of the endless belt 101 on the basis of fed back surface position information relating to the endless belt 101.

Figure 25A:
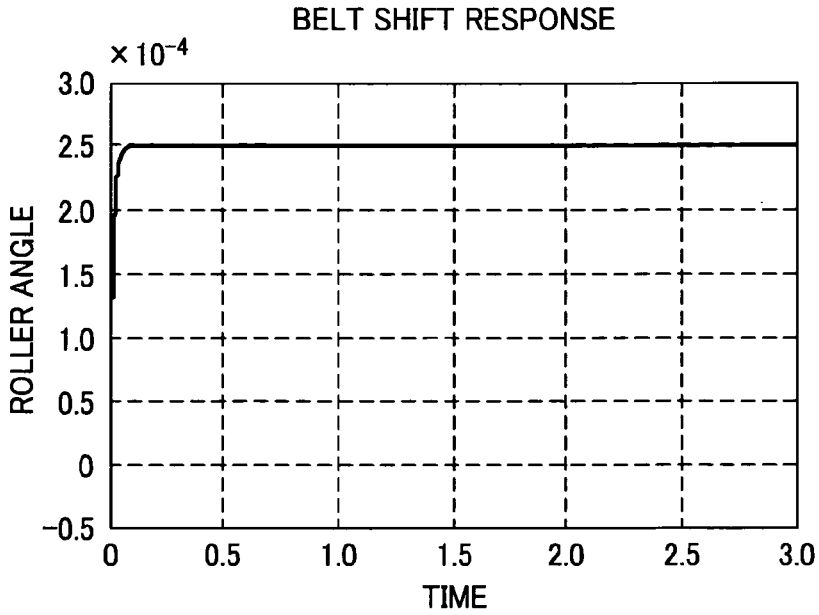
FIG. 25A is a view showing the time response of the roller angle.
Figure 25B:
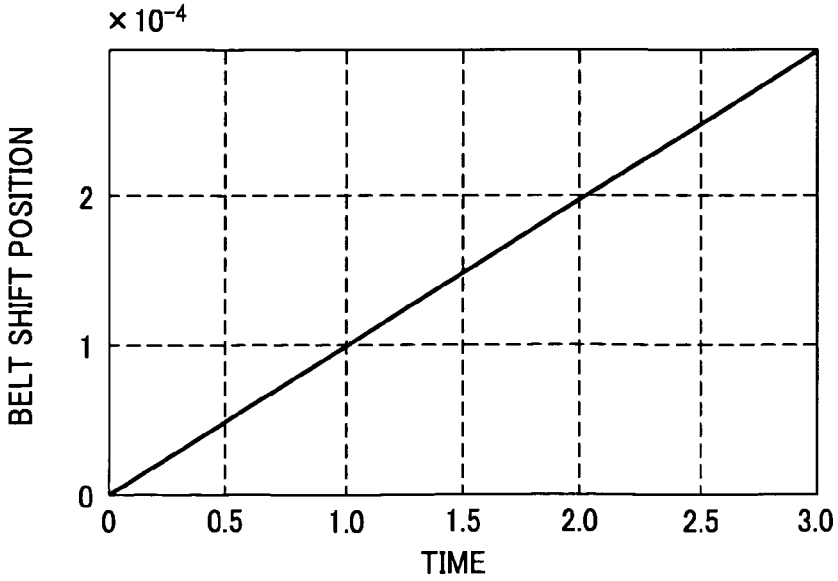
FIG. 25B is a view showing the time response of the belt shift position under identical conditions.

FIG. 25A is a view showing the roller angle time response when the belt traveling speed is 0.1 m/s and the target roller angle is 2.5 e-4 radians, in which the target value is matched. FIG. 25B is a view showing the time response of the belt shift position under the same conditions. A deviation of 100 μm occurs every second. Thus, when the reference belt traveling speed is 0.1 m/s and the reference roller angle is 2.5 e-4 radians, a deviation of 100 μm occurs every second.

In terms of the reference belt shift position variation rate γ

$$\gamma=0.1\ e\text{-}3/2.5\ e\text{-}4$$

Another example of the processing performed by the belt shift control means will now be described using FIG. 10B.

Figure 10B:
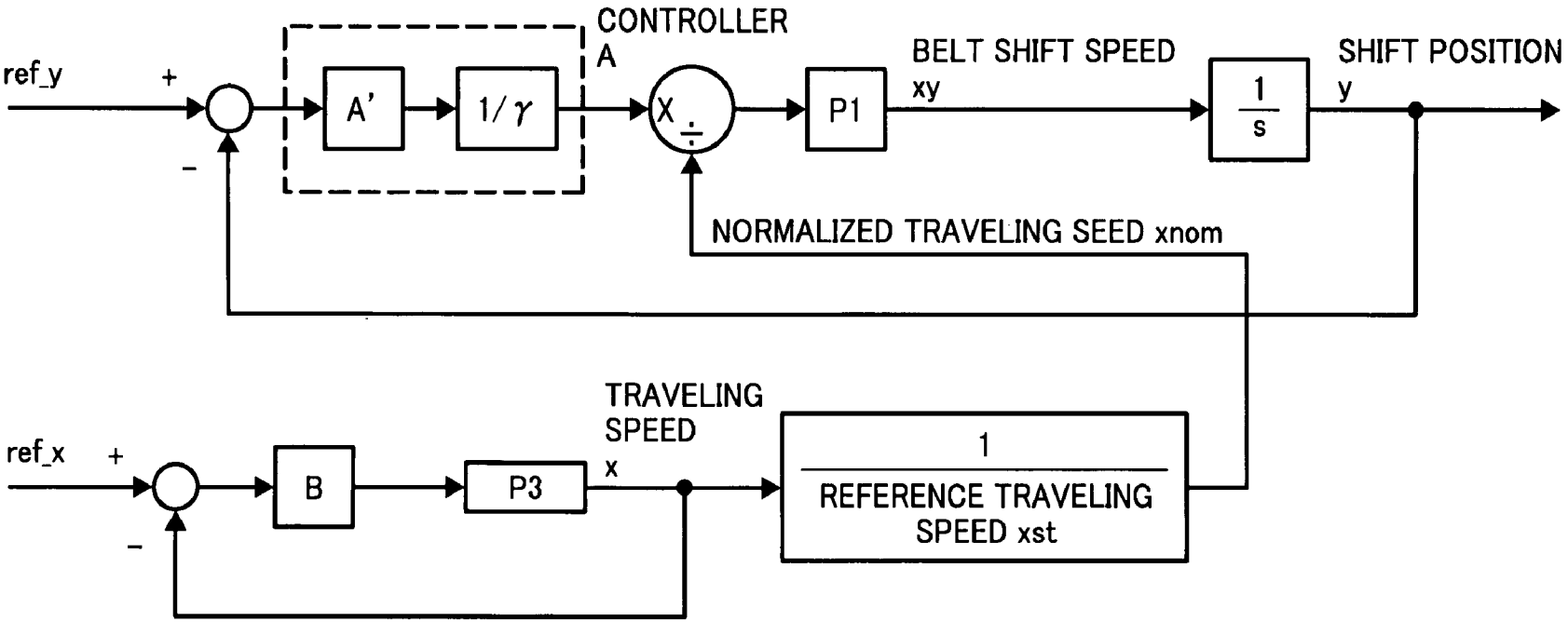

With the configuration shown in FIG. 10B, the controller A multiplies a reference belt shift position variation rate 1/γ by a proportional gain A'. The result is divided by a normalized traveling speed xnom, whereupon a drive signal is applied to a movable roller actuator via a driver such that the movable roller 300 moves in the vertical direction, thereby eliminating the effects of belt shifting (see FIGS. 9A and 9B).

FIGS. 26 through 30 show several examples of the response when belt shift control is performed in accordance with the embodiment described above.

Figure 26:
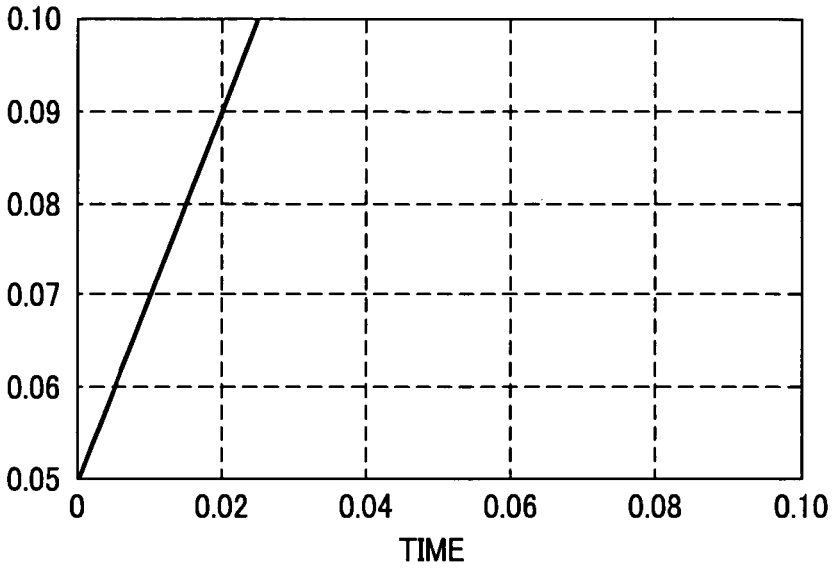
FIGS. 26 to 30 are examples of response when belt shift control is performed according to this embodiment.

FIG. 26 shows a case in which the belt traveling speed corresponds to a reference speed of 0.1 m/s.

Figure 27:
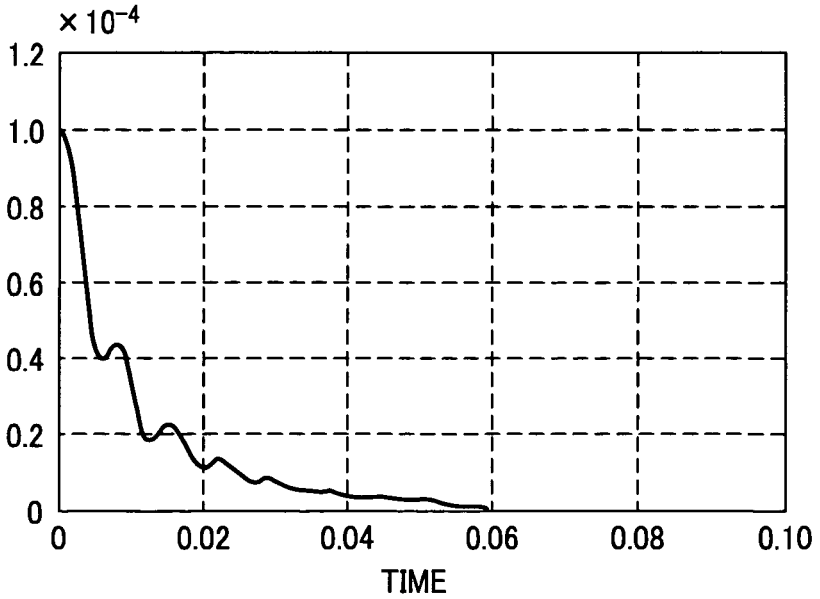

FIG. 27 shows the behavior of the belt shifting at this time, in which the initial position deviates 100 μm from the target position but is convergent with the target value.

Figure 28:
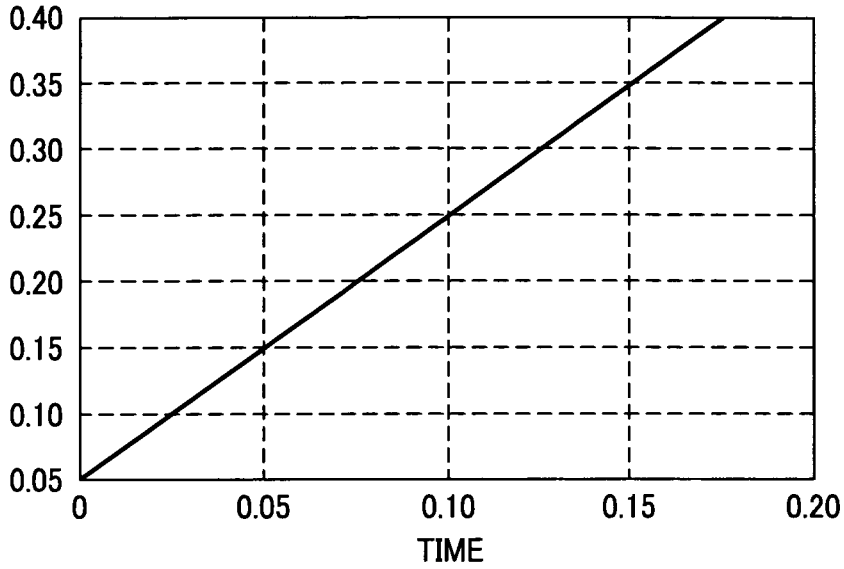

FIG. 28 shows a case in which the belt traveling speed is 0.4 m/s (the control shown in the lower portion of FIG. 1).

Figure 29:
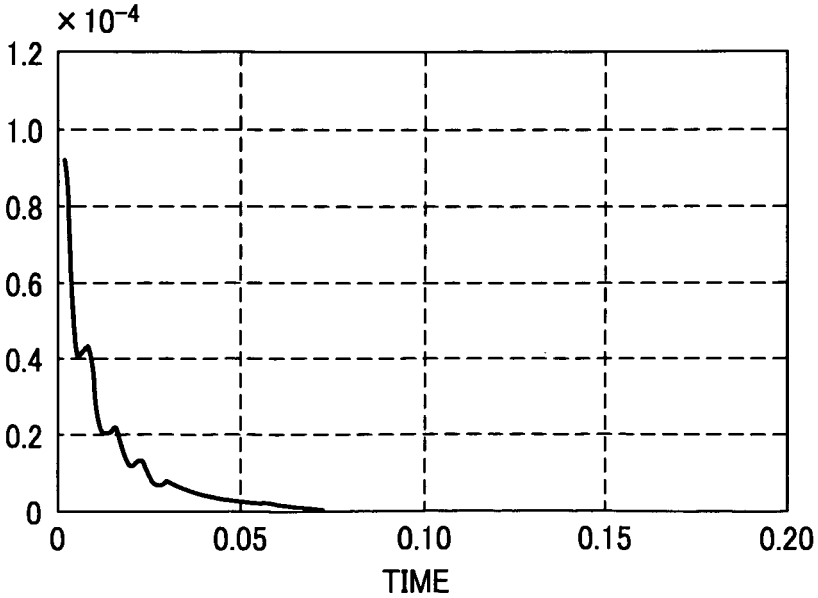

FIG. 29 shows the behavior of the belt shifting at this time, in which the initial position deviates 100 μm from the target position but is convergent with the target value. Control is performed in accordance with the lower portion of FIG. 1, and therefore stable control is achieved.

Figure 30:
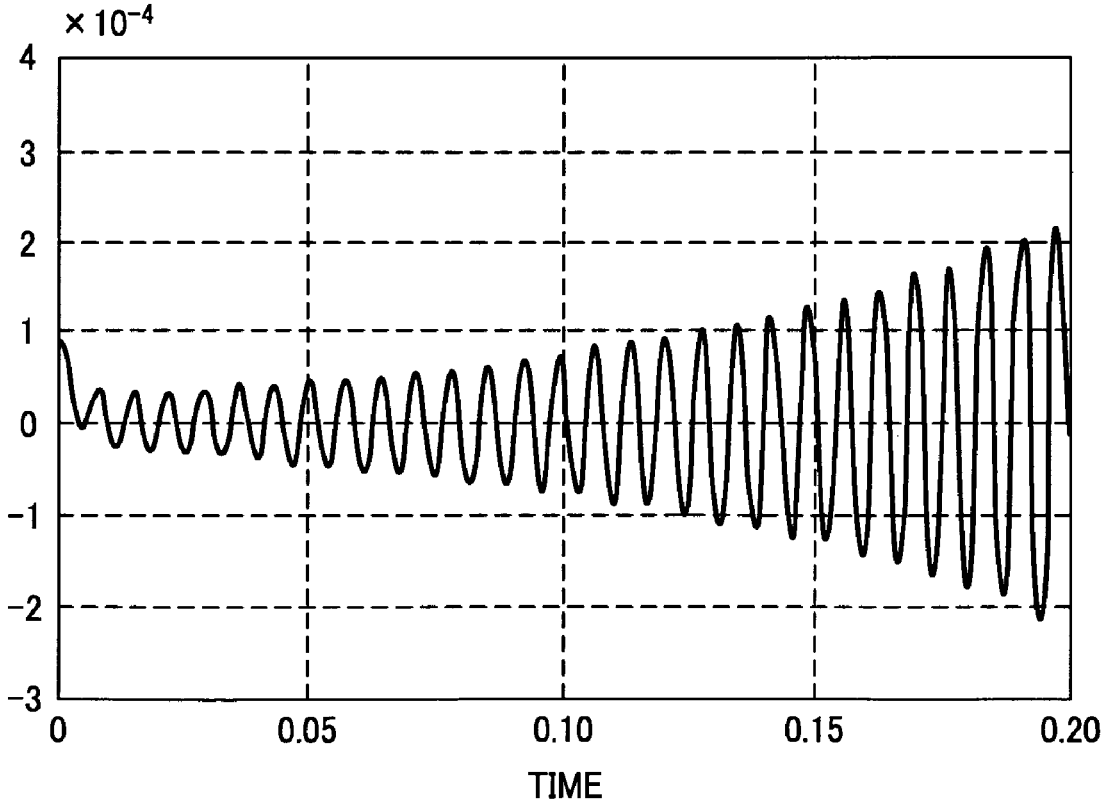

FIG. 30 shows a case in which the calculation result of the controller A is not divided by the normalized traveling speed xnom, but applied as is to the movable roller actuator via the driver. Here, the traveling speed is slow, and therefore the loop gain of the control system increases, leading to vibration.

In the belt moving device of this embodiment, the belt shift control means perform control to reduce shift position variation within a single round trip of the endless belt 101 by feeding back a target value for canceling out belt shift position variation within a single round trip of the endless belt 101 and feeding forward a value obtained by multiplying an inverse transfer characteristic of the roller moving means 300 by the transfer characteristic of the target value in relation to input into the pressing means (actuator) 306 of the roller moving means 300.

Figure 31:
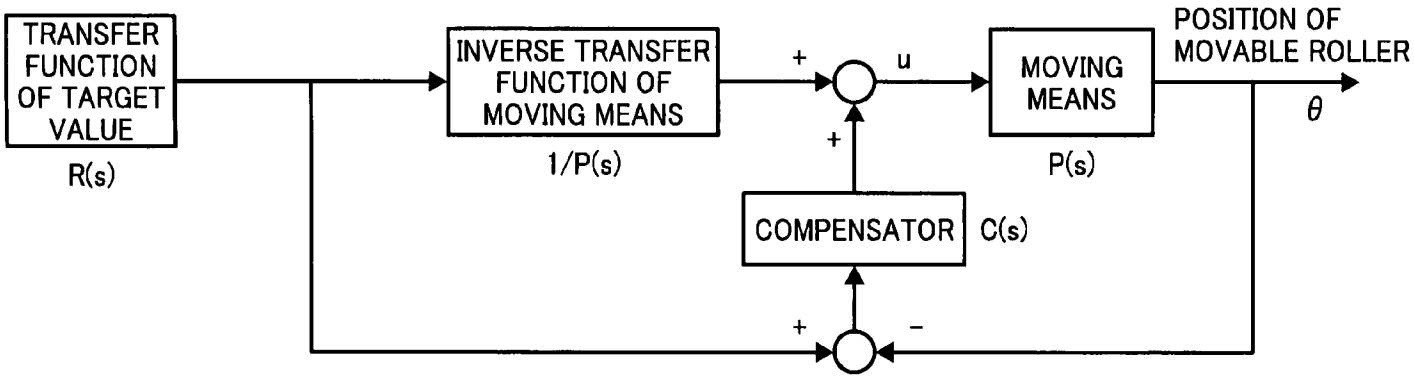
FIGS. 31 and 32 are block diagrams showing content input into the roller moving means when control is performed to reduce shift position variation within a single round trip of the endless belt.

FIG. 31 is a block diagram showing the content of the input into the roller moving means 300 (i.e. the pressing means (actuator) 306 thereof) when control is performed to reduce the shift position variation within a single round trip of the endless belt 101. Here, a value obtained by multiplying the inverse transfer characteristic (1/P(s)) of the roller moving means 300 by a transfer function R(s) of the target value of the roller moving means 300 is fed forward in relation to an input u into the pressing means (actuator) 306 of the roller moving means 300. Further, a deviation between the transfer function R(s) of the target value and the angle θ(s) of the movable roller 301, i.e. the output of the moving means, is calculated by a compensator, and a target value for canceling out the belt shift position variation within a single round trip of the endless belt 101 is fed back.

The following equation shows the output of the moving means (the angle of the movable roller) determined from the relationship shown in the block diagram of FIG. 31. Using Equation (12-1), the output of the moving means can be caused to follow the transfer function of the target value. In other words, by combining the feedback and feedforward operations described above, the output of the moving means can be matched to the target value with no time lag. Hence, by applying the target value for canceling out meandering in the main scanning direction caused by offset in the movable roller 301, main scanning meandering can be suppressed.

$$u=R(s)/P(s)+C(s)\,(R(s)-\theta(s)) \qquad \text{Eq. (12-1)}$$

$$\theta(s)=P(s)u \qquad \text{Eq. (12-2)}$$

Therefore $$\theta(s)=P(s)R(s)/P(s)+P(s)C(s)(R(s)-\theta(s))=R(s)+P(s)C(s)R(s)-P(s)C(s)\theta(s) \qquad \text{Eq. (12-3)}$$

$$\theta(s)(1+P(s)C(s))=R(s)(1+P(s)C(s)) \qquad \text{Eq. (12-4)}$$

$$\theta(s)=R(s) \qquad \text{Eq. (12-5)}$$

where R(s) is a transfer function of the target value,

P(s) is a transfer function of the moving means,

C(s) is a transfer function of the compensator, u is the input of the moving means, and θ(s) is the output of the moving means.

Figure 32:
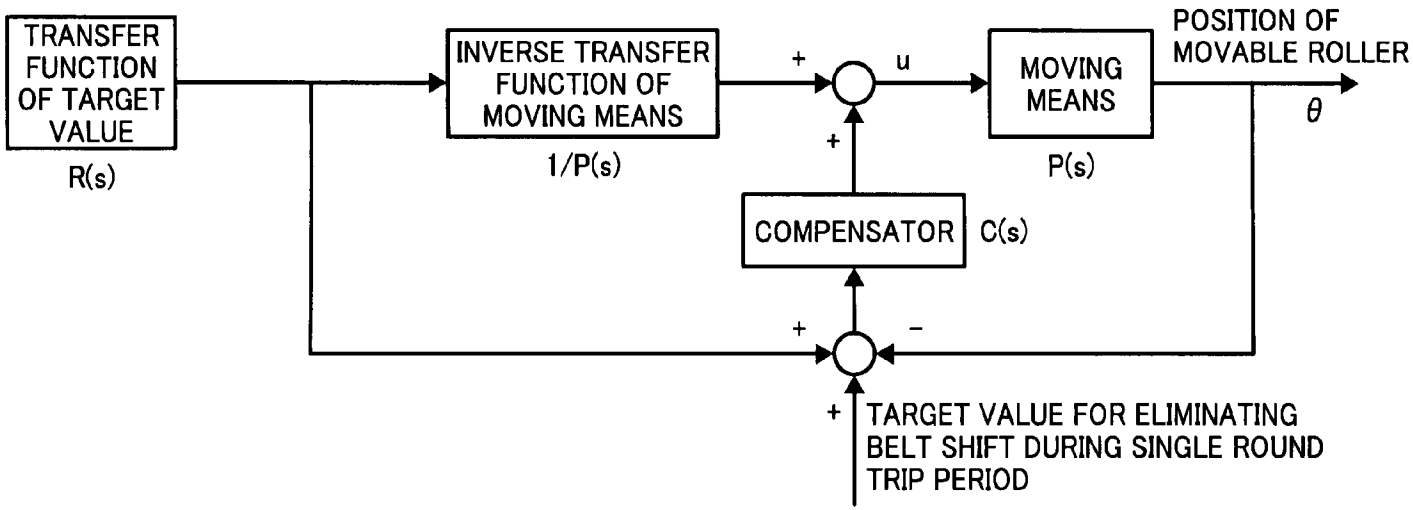

In addition to the constitution of FIG. 31, in the belt moving device of this embodiment, a different target value is preferably applied to correct the shifting that occurs within a single round trip of the endless belt 101. FIG. 32 is a block diagram showing the content of input into the roller moving means 300 (i.e. the pressing means (actuator) 306 thereof) in relation to this constitution. Here, a value obtained by multiplying the inverse transfer characteristic (1/P(s)) of the roller moving means 300 by the transfer function R(s) of the target value of the roller moving means 300 is fed forward in relation to the input u into the pressing means (actuator) 306 of the roller moving means 300. Further, a target value R2(s) calculated by the compensator for eliminating the shifting that occurs within a single round trip period of the endless belt 101 is added to the deviation between the transfer function R(s) of the target value and the angle θ(s) of the movable roller 301, i.e. the output of the moving means, and the resulting value is fed back.

The following equation shows the output of the moving means (the angle of the movable roller) determined from the relationship shown in the block diagram of FIG. 32. The first item on the right side of Equation (13-1) is the target value R(s) for canceling out meandering in the main scanning direction due to offset in the movable roller, and the second item is the target value R2(s) for eliminating shifting that occurs within a single round trip period of the endless belt due to tilting of the movable roller. Here, the target value R2(s) can be matched to the output θ(s) of the moving means when P(s) C(s) in the equation is sufficiently larger than 1, and thus main scanning shifting can be suppressed.

$$u=R(s)/P(s)+C(s)(R(s)+R2(s)-\theta(s)) \qquad \text{Eq. (13-1)}$$

$$\theta(s)=P(s)u \qquad \text{Eq. (13-2)}$$

Therefore $$\theta(s)=P(s)R(s)/P(s)+P(s)C(s)(R(s)+R2(s)-\theta(s))=R(s)+P(s)C(s)R(s)+P(s)C(s)R2(s)-P(s)C(s)\theta(s) \qquad \text{Eq. (13-3)}$$

$$\theta(s)(1+P(s)C(s))=R(s)(1+P(s)C(s))+P(s)C(s)R2(s) \qquad \text{Eq. (13-4)}$$

$$\theta(s)=R(s)+P(s)C(s)/1+P(s)C(S)R2(s) \qquad \text{Eq. (13-5)}$$

where R(s) is a transfer function of the target value,

P(s) is a transfer function of the moving means,

C(s) is a transfer function of the compensator, u is the input of the moving means, θ(s) is the output of the moving means, and R2(s) is a target value for eliminating shifting within a single round trip of the belt.

Figure 33A:
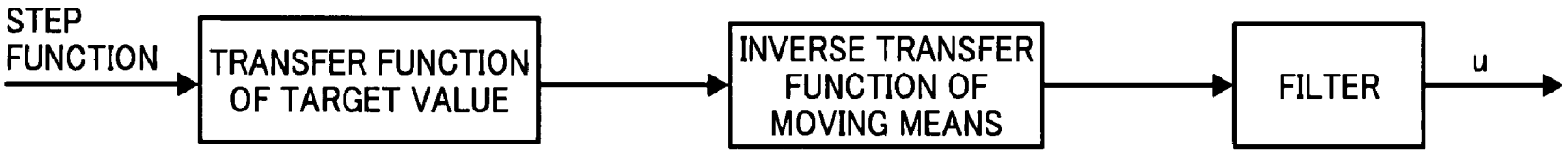
FIGS. 33A and 33B are block diagrams showing an example of a feedforward target value, from among the content input into the roller moving means when control is performed to reduce shift position variation within a single round trip of the endless belt.
Figure 33B:
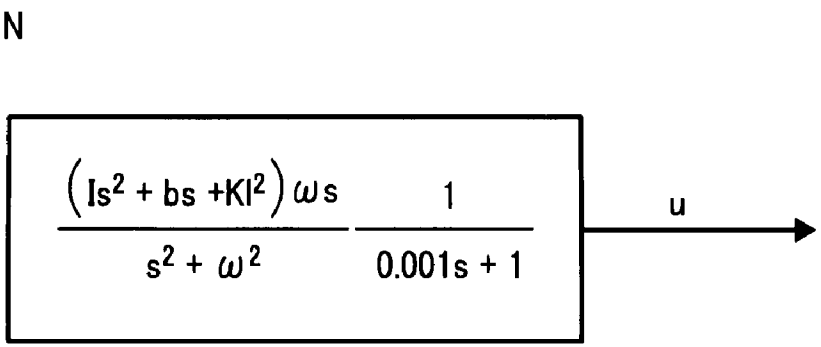

In the belt moving device that performs the control shown in the block diagram of FIG. 31 or FIG. 32, the transfer function of the target value of the movable roller 301 preferably takes the form of a sine wave, and the transfer characteristic of the roller moving means 300 that are subjected to the control is preferably a second order function. The derivation process relating to the feedforward item in Equations (12-2) and (13-2) under these conditions is illustrated in the following equation. Further, FIGS. 33A and 33B show block diagrams of the feedforward target value at this time. In Equation (14-3), the numerator has a high order that is difficult to realize, and therefore the numerator is multiplied by a filter having little effect on the transfer characteristic.

$$\Theta(s)=1/Is^2+bs+Kl^2U(s) \quad \text{Eq. (14-1)}$$

where the transfer characteristic Θ(s) of the moving means is the second order of Equation (14-1).

When the input of the transfer characteristic SIN(s) of the sine wave is a step function 1/s, $$\mathrm{SIN}(s)=\omega s/s^2+\omega^2 \quad \text{Eq. (14-2)}$$

Hence, the feedforward item is $$R(s)/P(s)=(Is^2+bs+Kl^2)\omega s/s^2+\omega^2 \quad \text{Eq. (14-3)}$$

In Equation (14-3), the order of the numerator is too high to be realized, and therefore the numerator is multiplied by a filter having little effect on the transfer characteristic.

$$R(s)/P(s)=(Is^2+bs+Kl^2)\omega s/s^2+\omega^2 1/0.001s+1 \quad \text{Eq. (14-4)}$$

In the belt moving device of this embodiment, the meander amount within a single round trip of the endless belt 101 is preferably detected by the main scanning detection sensor (2D sensor 108A) after eliminating the movement amount of the belt within a single round trip using the roller moving means 300.

Figure 34:
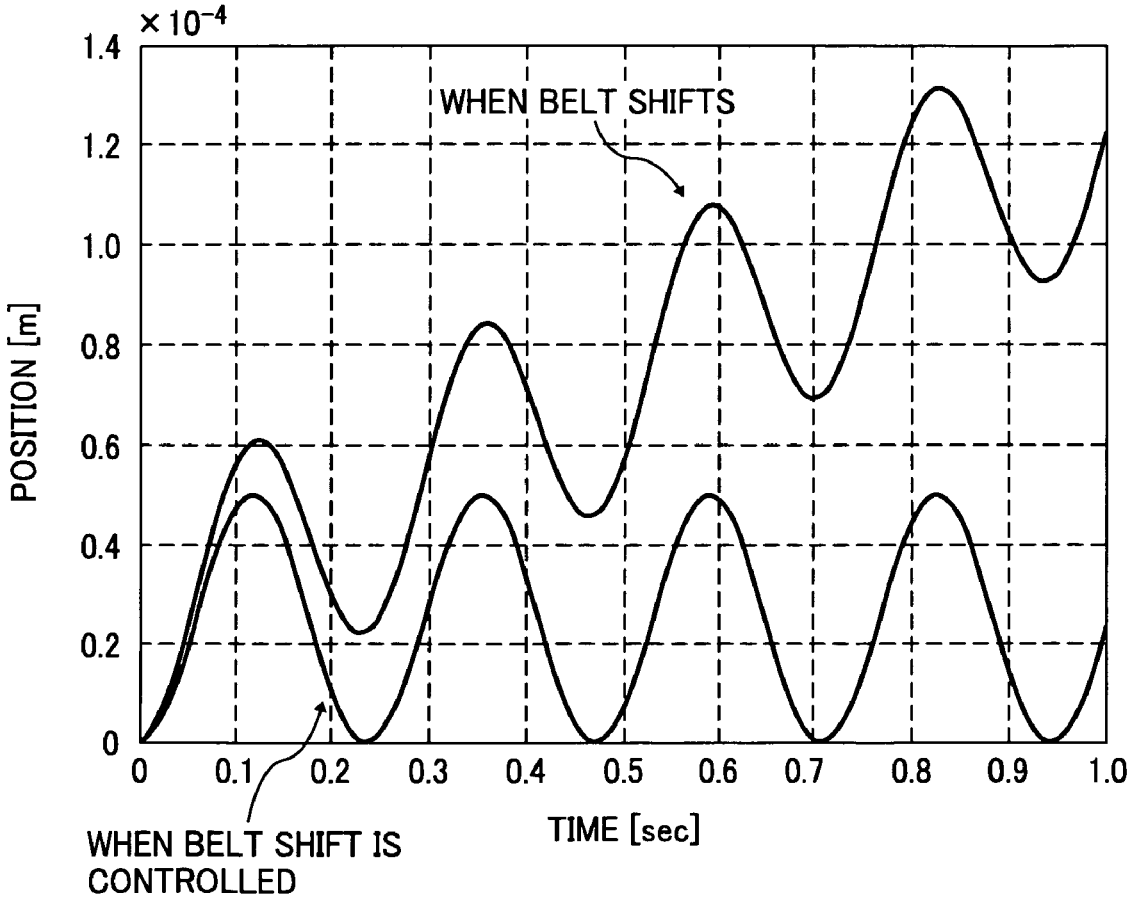
FIG. 34 is a view showing positional variation in the main scanning direction of the endless belt incases where the movement amount of the belt within a single round trip period is removed and not removed by the belt moving means when detecting the meander amount of the belt within a single round trip.

FIG. 34 shows positional variation in the belt main scanning direction in cases where the movement amount of the belt within a single round trip is removed using the roller moving means 300 and not removed when detecting the meander amount of the endless belt within a single round trip. When movement is not removed by the roller moving means 300 (when the belt shift shown in the drawing occurs), both meandering and shifting occur. In FIG. 34, a shift of approximately 120 μm per second occurs. On the other hand, when the movement is removed by the roller moving means 300 (the belt shift in the drawing is controlled), shifting of the endless belt is eliminated, and only meandering of approximately 50 μm occurs due to offset of the movable roller. In this case, the frequency and the magnitude of the meandering are known, and therefore the meandering can be suppressed by applying a target value for canceling it out.

Figure 35A:
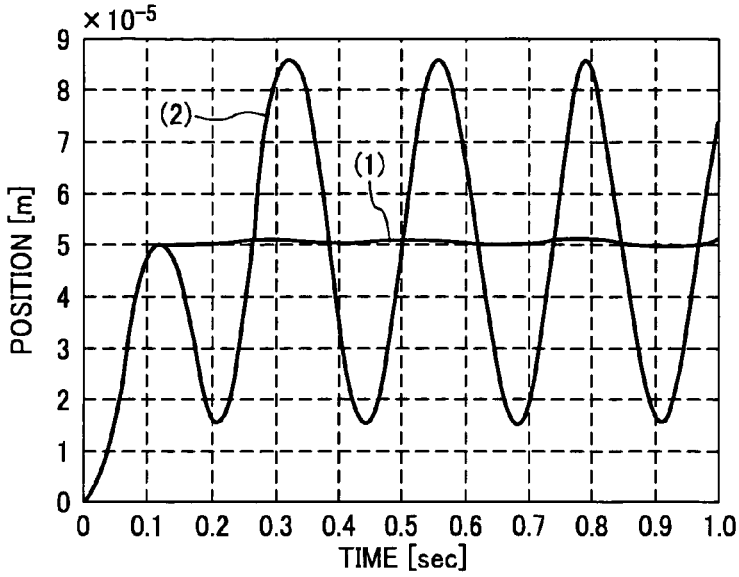
FIGS. 35A to 35C are illustrative views of a case in which a target value is determined by subtracting the meander amount of the endless belt, detected by a 2D sensor, from a value of a roller angle detection sensor and the meander amount.
Figure 35B:
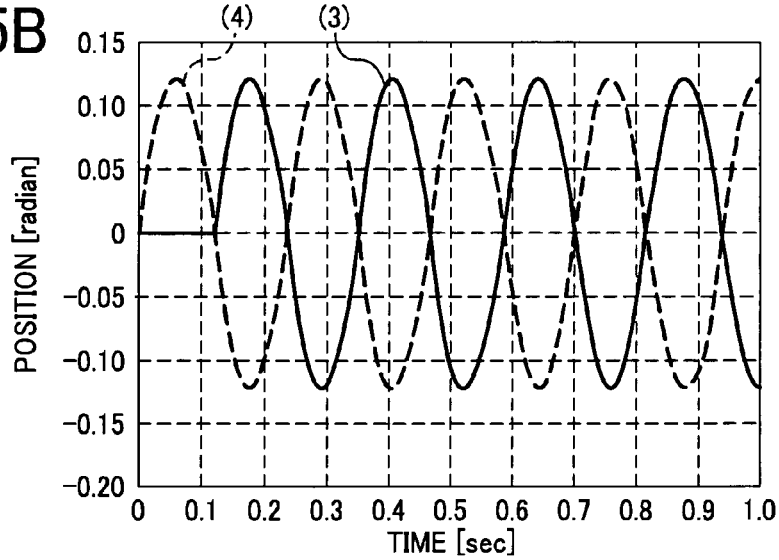
Figure 35C:
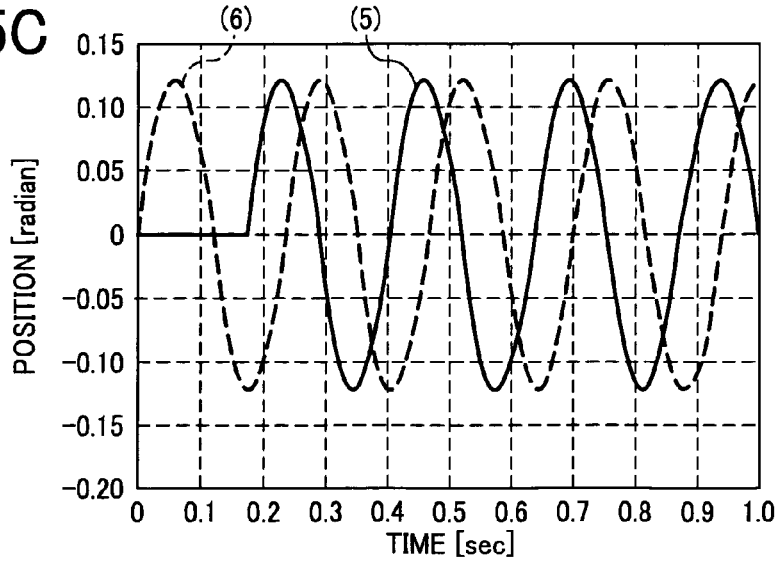

Also in the belt moving device of this embodiment, the target value R(s) is preferably determined by subtracting the meander amount of the endless belt 101 detected by the 2D sensor 108A from the value of the roller angle detection sensor for detecting the roller angle of the movable roller 301 and the meander amount. FIGS. 35A through 35C are illustrative views of this process.

A curve (1) in FIG. 35A shows a case in which the target value of the roller angle of the moving means 300 is correct. The magnitude, frequency, and phase of the roller angle of the moving means 300 have all been set correctly, and therefore meandering generated as a result of offset in the movable roller 301 can be suppressed. A solid line (3) in FIG. 35B denotes the target value in this case. A dotted line (4) in the drawing denotes fluctuation in the roller angle caused by offset of the movable roller, and indicates the relationship by which the target value cancels out the fluctuation in the roller angle.

Meanwhile, a curve (2) in FIG. 35A shows a case in which the target value of the roller angle of the moving means 300 is incorrect. The magnitude and frequency of the roller angle of the moving means 300 are correct, but the phase is incorrect, and therefore meandering generated as a result of offset in the movable roller 301 cannot be suppressed. A solid line (5) in FIG. 35C denotes the target value in this case. A dotted line (6) in the drawing denotes fluctuation in the roller angle caused by offset of the movable roller. Since the phase of the target value is incorrect, fluctuation in the roller angle increases, leading to an increase in meandering.

Figure 36:
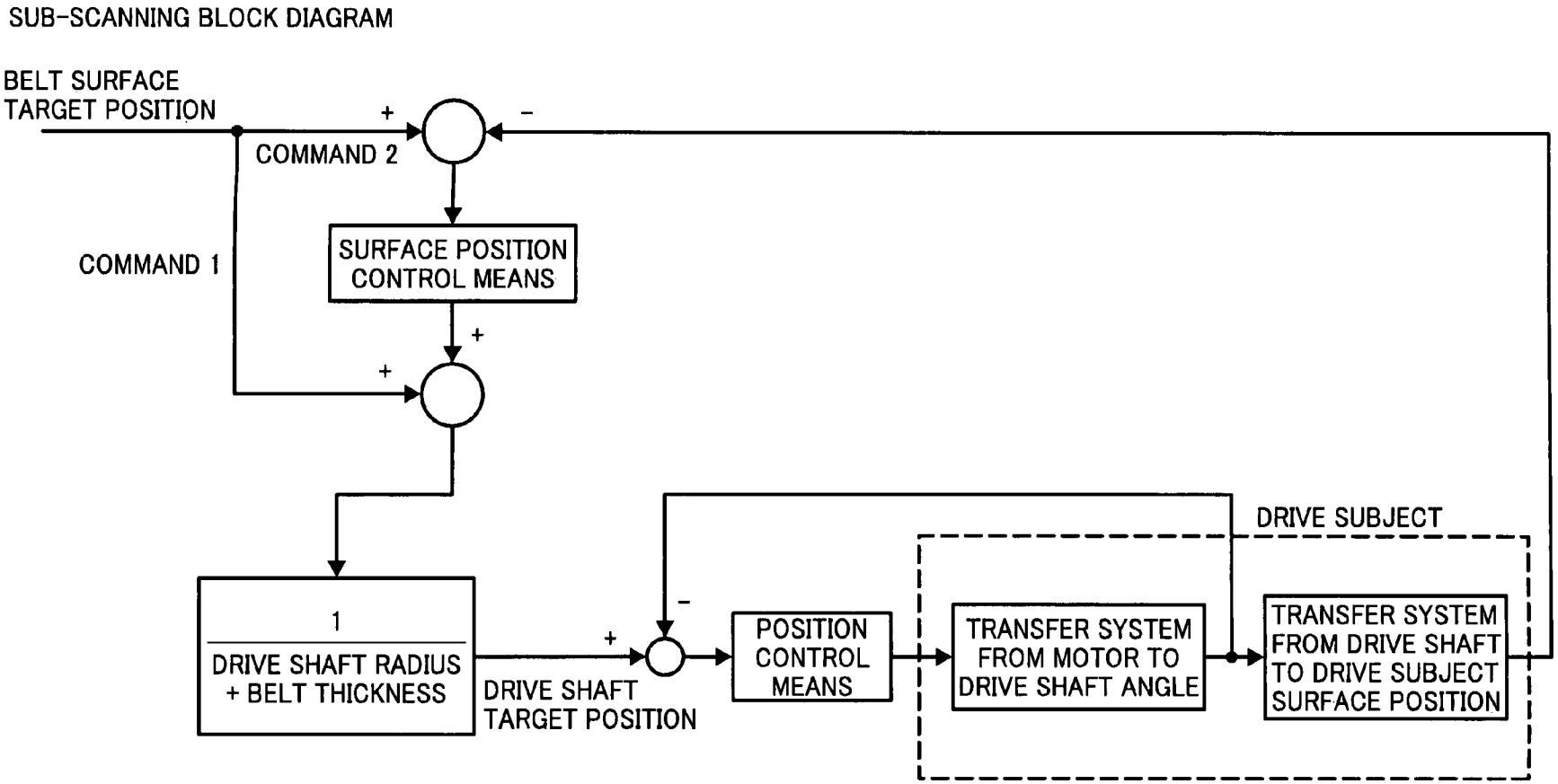
FIG. 36 is a block diagram showing a constitution relating to position control of a drive subject according to this embodiment.

As described above, in this embodiment, position control (shift control) is performed in the main scanning direction, but in addition to the shift control described heretofore, well-known position control in the sub-scanning direction may be performed simultaneously. For this purpose, a technique disclosed in the aforementioned Japanese Unexamined Patent Application Publication 2003-241535 may be employed. FIG. 36 is a block diagram showing control parts when position control is performed in the sub-scanning direction of a drive subject by feeding back the surface position of the drive subject.

A belt surface target position command 1 is converted directly into a drive shaft target position (angle). A command 2 is compared to the surface target position, whereupon the deviation therebetween is calculated using surface position control, converted into a drive shaft target position (angle), and added to the command 1. The deviation between the drive shaft target position (angle) and the drive shaft angle is calculated by position control means and applied to a motor as a current, whereupon the drive subject is driven to follow the target position. When there is no deviation in the surface position, drive shaft position control is performed in accordance with the command 1, and when a deviation occurs in the surface position due to belt slippage, offset of the drive shaft, and so on, the drive shaft target angle is corrected to eliminate the deviation.

Incidentally, using the shift detecting constitution described above, a function for monitoring irregularities in the device may be added easily. More specifically, by adding monitoring means for determining an irregularity in the belt moving device when it is detected that the relationship between the movable roller moving direction and the belt shift direction has reversed, the reliability of the device can be improved.

When the belt moving device of this embodiment is used as an intermediate transfer belt device of an image forming apparatus, positioning control can be performed with a high degree of precision in both the main scanning direction and sub-scanning direction, enabling the realization of an image forming apparatus in which color shift is suppressed, and hence this application is particularly favorable. However, the belt moving device of this embodiment is not limited to an image forming apparatus, and may be applied widely as a belt moving device for various other apparatuses with the aim of similarly improving precision.

Note that an intermediate transfer belt for an image forming apparatus was described above, but the belt moving device of the present invention is not limited thereto, and may of course be used as a belt moving device other than an intermediate transfer belt. The effects of the present invention as a belt moving device that can be driven with a high degree of precision are exhibited by subjecting the movement direction and shift direction positions of the belt to feedback control.

According to the above embodiment, the following effects are obtained.

(1) By subjecting the position in the belt shift direction to feedback control and feedforward control, a movable roller response with no time lag can be realized, and meandering in the main scanning direction due to offset in the movable roller can be suppressed.

(2) By adding a target value for correcting belt shifting within a single round trip period to the feedback control and feedforward control, shifting in the main scanning direction caused by tilting of the drive roller and movable roller can be suppressed, and a belt moving device in which an endless belt is not provided with a shift stopper can be realized.

(3) Since the target value takes the form of a sine wave and the control subject is of a second order, control to match the output to the target value with no time lag can be realized, and therefore meandering in the main scanning direction due to roller offset can be suppressed.

(4) By driving the belt in a roller position in which the shift amount of the belt within a single round trip period is smallest, the offset frequency and phase of the roller and the belt meander amount can be detected, and therefore a target value for correcting the meander a mount can be determined. Thus, meandering in the main scanning direction due to roller offset can be suppressed.

(5) According to the method of determining the target value for reducing the meander amount, the fact that roller offset occurs during each revolution is taken into account, and therefore phase deviation does not occur in the target value. Thus, meandering in the main scanning direction can be suppressed.

(6) The belt moving device is capable of performing positioning control with a high degree of precision in both the main scanning direction and sub-scanning direction of the intermediate transfer belt device, and therefore color shift in an image forming apparatus can be suppressed.

(7) By moving the endless belt at a constant speed and determining the movable roller position in which the belt shift amount is smallest, the shift amount can be suppressed even when the movable roller is not in an optimum position due to assembly irregularities. In other words, the optimum movable roller position can be found automatically by actually moving the endless belt, and therefore a belt moving device not provided with a belt shift stopper can be realized even when assembly irregularities occur among devices.

(8) The movable roller position in which the belt shift amount is smallest can be determined from the data of two points in each movable roller position. In other words, in comparison with a case in which the movable roller is moved to determine the optimum position through a process of trial and error, the optimum position of the movable roller can be determined efficiently from the relationship between the movable roller position and the characteristics of the belt shifting operation.

(9) As regards the behavior of the endless belt, the belt shifts due to tilting of the movable roller and drive roller, and also meanders due to roller offset. However, by making the circumference of the endless belt an integral multiple of the circumference of the movable roller, the effects of roller offset during a single round trip of the endless belt can be removed, and therefore the belt shift amount can be determined accurately. In other words, by making the circumference of the endless belt an integral multiple of the circumference of the movable roller, the geometrical disposition of the roller is identical to that of the previous round trip of the endless belt following a single round trip of the belt, and therefore the belt shift amount can be determined accurately.

(10) Even when belt shifting occurs, the endless belt can be returned to its initial position by moving the position of the movable roller. More specifically, when the endless belt makes many round trips, belt shifting occurs little by little even if control is performed in real time to set the position of the movable roller in the target position through feedback. However, by returning the belt shift position to the initial position, the belt moving device can be returned to a movable state automatically.

(11) The moving means are constituted by a moment of inertia, a spring, and an actuator, thereby forming a so-called resonance system, and by providing the controller with an integrator, the control can be stabilized. In other words, by providing the controller with an integrator, a position control system that is stable at all times can be realized, even when external disturbances such as frictional force and gravitational force are applied to the moving means.

(12) The surface position of the endless belt is fed back, and therefore the endless belt can be driven with a high degree of precision. More specifically, unlike conventional rotary encoder system feedback of a drive shaft and a motor shaft, the surface position of the endless belt is fed back directly, and therefore the endless belt can be driven with a high degree of precision.

(13) By determining an irregularity when the relationship between the position of the movable roller and the belt shift direction reverses, damage to the endless belt can be prevented. More specifically, when the belt shift position exceeds a prescribed value and the endless belt is moved after moving the movable roller, it is possible to detect the roller angle and belt shifting, and therefore the relationship between the position of the movable roller and the belt shift direction can be learned. When the relationship reverses, an irregularity is determined.

Various modifications will become possible for those skilled in the art after receiving the teachings of the present disclosure, without departing from the scope thereof.

What is claimed is:

1. A belt moving device comprising:

an endless belt;

a drive roller for moving/stopping the endless belt;

at least one opposing roller disposed in a position opposing the drive roller;

a motor for rotating the drive roller;

a position detecting device that detects a position of the endless belt;

a moving device that moves at least one of the rollers to a vertical direction target rotation position; and a belt shift controller that controls belt shift in accordance with a traveling speed of the endless belt while the endless belt is in motion, wherein, in the belt shift controller, a deviation obtained by subtracting a belt shift position from a target shift position is calculated using a first controller A, a value thereof is multiplied by a shifting amount per unit time corresponding to a reference belt shift position variation rate, a value thereof is subtracted from a value obtained by subtracting the belt traveling speed from a reference belt traveling speed for determining the reference belt shift position variation rate and the belt traveling speed, and a result thereof is calculated as a position control value, and by using the position control value to perform vertical direction drive control on the movable roller, the roller is moved in the vertical direction by the moving device, whereby the endless belt is subjected to position control.

2. The belt moving device as claimed in claim 1, wherein, when the belt traveling speed is close to zero, a determined value other than zero is used as a belt traveling speed value for calculating the position control value.

3. The belt moving device as claimed in claim 2, wherein the shifting amount of the endless belt per unit time is determined in advance by moving the belt at a constant speed in a state where a position of the movable roller is fixed in the vertical direction target rotation position.

4. The belt moving device as claimed in claim 3, wherein the belt shift controller is configured to fix the position of the roller, detect the position of the roller and output corresponding feedback signals, and a third controller C is configured to include an integrator for integrating the feedback signals.

5. The belt moving device as claimed in claim 4, wherein the first controller A of the belt shift controller multiplies a reference belt shift position variation rate $1/\gamma$ by a proportional gain A'.

6. The belt moving device as claimed in claim 5, wherein surface position feedback is performed by a second controller B.

7. The belt moving device as claimed in claim 6, further comprising a monitoring device that determines an irregularity when a relationship between a movement direction of the movable roller and a belt shift direction is reversed.

8. The belt moving device as claimed in claim 7, wherein the belt shift controller determines a roller position in which the shifting amount of the endless belt (belt shifting amount) is smallest in advance by moving the endless belt at a constant speed in a state where a vertical position of the movable roller (roller position) in the moving device is fixed.

9. The belt moving device as claimed in claim 1, wherein the position in which the belt shifting amount is smallest is determined from at least two points, namely a belt shifting amount in an initial position of the movable roller and a belt shifting amount when the movable roller is moved to another position.

10. The belt moving device as claimed in claim 9, wherein a circumference of the endless belt is an integral multiple of a circumference of the movable roller, and the belt shifting amount is a value obtained when the endless belt has moved a distance corresponding to the circumference of the endless belt or a distance corresponding to an integral multiple of the circumference of the endless belt.

11. The belt moving device as claimed in claim 10, wherein the belt shift controller detects a shift position of the endless belt at the same time as the movable roller is caused to follow a target position while the roller position of the moving device is fed back, and when the endless belt deviates from a predetermined shift position, the roller position of the moving device is modified such that the endless belt moves to the predetermined shift position, and after moving to the predetermined shift position, the endless belt is set in a roller position in which the belt shifting amount is smallest.

12. The belt moving device as claimed in claim 11, wherein the belt shift controller is configured to include an integrator for integrating feedback signals serving as information relating to a detected roller position of the moving device, and further includes a controller for controlling the moving device to fix the roller position of the moving device.

13. The belt moving device as claimed in claim 12, wherein the belt shift controller includes a controller for controlling a movement direction of the endless belt on the basis of fed back information relating to a surface position of the endless belt.

14. The belt moving device as claimed in claim 13, wherein the belt shift controller determines an irregularity when the endless belt moves to a roller position in which the belt shifting amount is smallest and the endless belt shifts beyond a predetermined value.

15. A belt moving device comprising:

an endless belt;

a drive roller for moving/stopping the endless belt;

at least one opposing roller disposed in a position opposing the drive roller;

a motor for rotating the drive roller;

a position detecting device that detects a position of the endless belt;

a moving device that moves at least one of the rollers to a vertical direction target rotation position; and a belt shift controller that controls belt shift in accordance with a traveling speed of the endless belt while the endless belt is in motion, wherein the belt shift controller reduces shift position variation within a single round trip of the endless belt by feeding back a target value for canceling the shift position variation within a single round trip of the endless belt and feeding forward a value obtained by multiplying an inverse transfer characteristic of the moving device by a transfer characteristic of a target value of the moving device in relation to the control content of the moving device.

16. The belt moving device as claimed in claim 15, wherein the belt shift controller applies a different target value to correct shifting that occurs within a single round trip period of the endless belt.

17. The belt moving device as claimed in claim 16, wherein a transfer function of a target value of the moving device takes the form of a sine wave, and a transfer characteristic of the moving device is a second order function.

18. The belt moving device as claimed in claim 17, wherein shift position variation within a single round trip of the endless belt is detected by a main scanning detection sensor after removing a movement amount of the endless belt within a single round trip period using the moving device.

19. A tandem type image forming apparatus using a belt moving device as an intermediate transfer belt, the belt moving device comprising:

an endless belt;

a drive roller for moving/stopping the endless belt;

at least one opposing roller disposed in a position opposing the drive roller;

a motor for rotating the drive roller;

a position detecting device that detects a position of the endless belt;

a moving device that moves at least one of the rollers to a vertical direction target rotation position; and a belt shift controller that controls belt shift in accordance with a traveling speed of the endless belt while the endless belt is in motion, wherein, in the belt shift controller, a deviation obtained by subtracting a belt shift position from a target shift position is calculated using a first controller A, a value thereof is multiplied by a shifting amount per unit time corresponding to a reference belt shift position variation rate, a value thereof is subtracted from a value obtained by subtracting the belt traveling speed from a reference belt traveling speed for determining the reference belt shift position variation rate and the belt traveling speed, and a result thereof is calculated as a position control value, and by using the position control value to perform vertical direction drive control on the movable roller, the roller is moved in the vertical direction by the moving means, whereby the endless belt is subjected to position control.

* * * * *